US005803817A

United States Patent [19]

Stern

[11] Patent Number: 5,803,817

[45] Date of Patent: Sep. 8, 1998

[54] INFANT SWING

[75] Inventor: Carl M. Stern, Pennington, N.J.

[73] Assignee: Fisher-Price, Inc., East Aurora, N.Y.

[21] Appl. No.: 698,371

[22] Filed: Aug. 15, 1996

[51] Int. Cl.[6] ..... A63G 9/00

[52] U.S. Cl. ..... 472/118; 472/119

[58] Field of Search ..... 472/118, 119, 472/120, 121, 122, 123, 124, 125, 135; 403/150, 157, 152

[56] References Cited

U.S. PATENT DOCUMENTS

| | | |
|---|---|---|
| 16,942 | 3/1857 | Wellman . |
| 194,003 | 8/1877 | Schlueter . |
| D. 368,816 | 4/1996 | Mitchell et al. . |
| 3,459,423 | 8/1969 | Meade . |
| 3,528,657 | 9/1970 | Krupsky . |
| 3,649,074 | 3/1972 | McDonald et al. . |
| 3,883,136 | 5/1975 | Kim . |
| 3,990,667 | 11/1976 | Tomalinas, Jr. . |
| 4,148,504 | 4/1979 | Rushing . |
| 4,181,299 | 1/1980 | Foster . |
| 4,240,625 | 12/1980 | Meeker . |
| 4,256,300 | 3/1981 | Boucher . |
| 4,271,627 | 6/1981 | Echterling . |
| 4,324,432 | 4/1982 | Eldon, III et al. . |
| 4,325,578 | 4/1982 | Borucki . |
| 4,371,206 | 2/1983 | Johnson, Jr. . |
| 4,634,175 | 1/1987 | Wise . |
| 4,634,177 | 1/1987 | Meeker . |
| 4,688,850 | 8/1987 | Brownlie et al. . |
| 4,697,845 | 10/1987 | Kamman . |
| 4,744,599 | 5/1988 | Jankowski et al. . |
| 4,805,902 | 2/1989 | Casagrande . |
| 4,807,872 | 2/1989 | Spilman et al. . |
| 4,822,033 | 4/1989 | Kohus et al. . |
| 4,940,229 | 7/1990 | Foster . |
| 4,943,113 | 7/1990 | Meeker . |
| 5,092,004 | 3/1992 | Cone et al. . |
| 5,143,419 | 9/1992 | Tepper et al. . |
| 5,277,472 | 1/1994 | Freese et al. . |
| 5,322,343 | 6/1994 | Parker et al. . |
| 5,392,476 | 2/1995 | Williams . |
| 5,505,413 | 4/1996 | Hennessey . |
| 5,525,113 | 6/1996 | Mitchell et al. . |

FOREIGN PATENT DOCUMENTS

| | | |
|---|---|---|
| WO 96/14120 A | 5/1996 | WIPO . |

*Primary Examiner*—Kien T. Nguyen
*Attorney, Agent, or Firm*—Morgan, Lewis & Bockius LLP; C. Scott Talbot; Howard R. Richman

[57] ABSTRACT

An infant's swing is disclosed that has a frame, a swing arm, and a seat releasably mounted on the swing arm by a seat-to-frame coupler assembly that includes a pivot plate mounted to the back of the seat and a T-shaped connector mounted to the lower end of the swing arm. The connector is received in a mating cavity formed in the rear surface of the pivot plate, and the connector is engaged with the cavity by cooperation of slots in the cavity and posts on the connector. The pivot plate is pivotally mounted to the seat to permit the seat to pivot between a recline position and an upright position.

13 Claims, 29 Drawing Sheets

INFANT SWING

BACKGROUND OF THE INVENTION

The present invention relates to infant swings that include an infant seat suspended by an arm. More particularly, it relates to the attachment mechanism for pivotally attaching the infant seat to the arm movement of the seat, relative to the arm, between a cradle orientation and a swing orientation.

Infant swings are well known in the art. In conventional swings, a seat is suspended from a pair of arms that hang down from a crosspiece, with the arms being connected to either side of the seat. Unfortunately this arrangement makes it awkward to put the child into, or take the child out of, the swing because the crosspiece extends across the swing over the seat. The crosspiece blocks easy access to the seat, causing a parent to bend and stretch to put a child into the seat. A better arrangement would present the seat to the parent in a way that didn't require a bend and stretch movement.

One solution to improve accessibility of the seat is to eliminate the crosspiece. In one approach to eliminating the crosspiece, a pair of inverted U-shaped leg assemblies are tilted toward each other and joined at their upper ends. Again, the seat is suspended by a pair of arms, each arm being suspended from one of the joints at the upper ends of the U shaped leg assemblies. The two top joints define a fixed horizontal axis of rotation about which the seat swings. Although this frame permits ready access to the seat from front and top, it inhibits access from the sides of the swing. An alternative approach is to form the frame from two C-shaped legs, angled together and joined at the tops of the legs. A single swing arm swings about a horizontal axis through the joint. This permits ready access from front and sides. However, it is relatively more difficult to couple the seat to a single swing arm than to two opposed swing arms. One solution is to form the lower end of the arm in a U-shape, with the seat engaged in the U. However, in this approach the seat is not removable from the arm. It would be advantageous to have a swing with a single swing arm from which the seat can be readily removed, preferably while leaving the child in the seat.

SUMMARY

An infant swing embodying the principles of the present invention includes a plurality of legs and a swing arm mounted to the legs for swinging about a horizontal swing axis. An infant seat is mounted to the lower end of the swing arm by a seat-to-swing coupler that includes a T-shaped connector with laterally extending posts that is received in a T-shaped receiving cavity of a pivot plate, with slots in the sidewall of the cavity that slidingly receive the connector posts. The pivot plate is pivotably mounted to the seat to permit the seat to be disposed in an upright orientation and a reclined orientation.

DETAILED DESCRIPTION

Figure 1A:
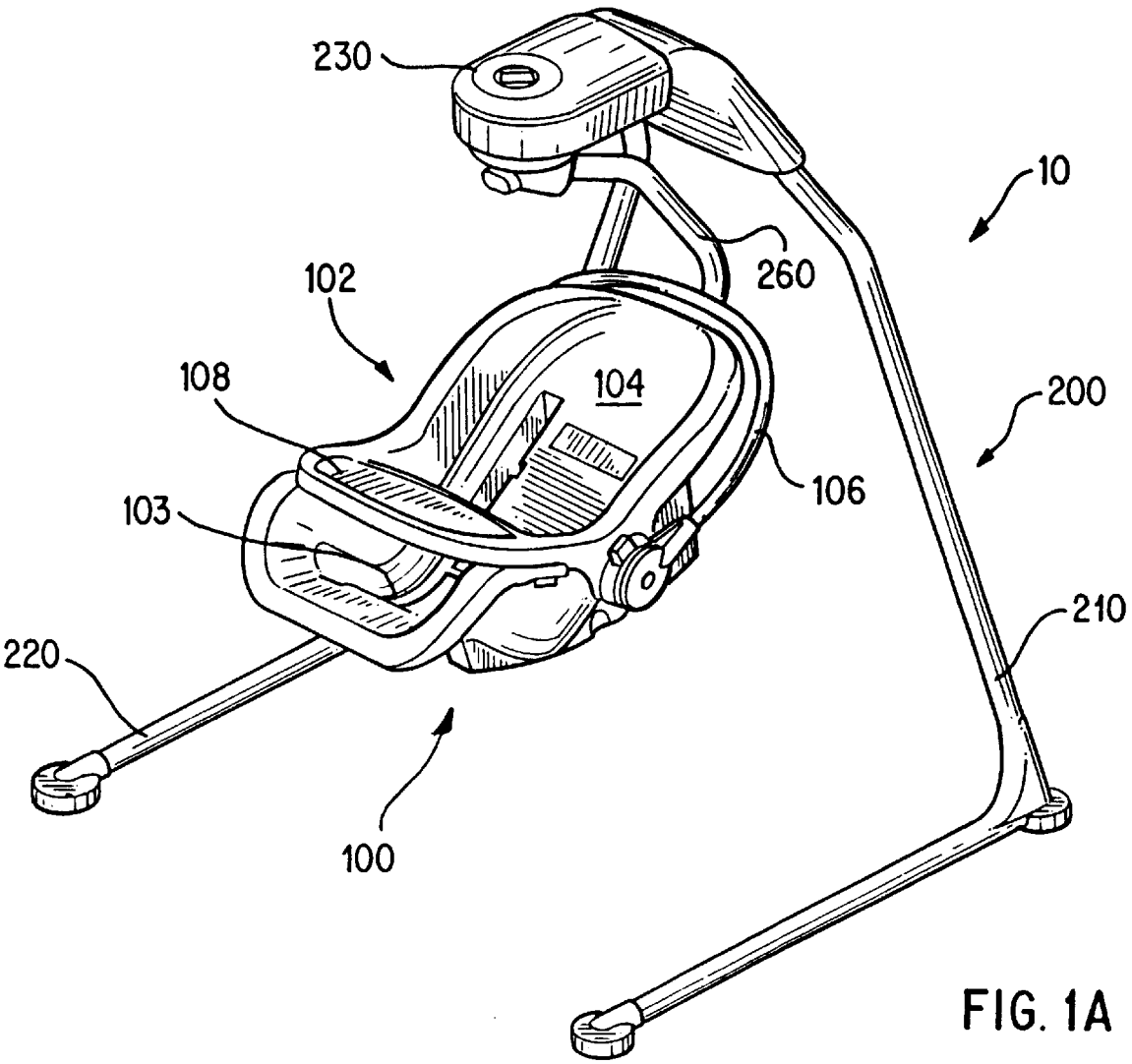
FIGS. 1A–1C are perspective, front, and side views of a swing embodying the principles of the present invention.
Figure 1B:
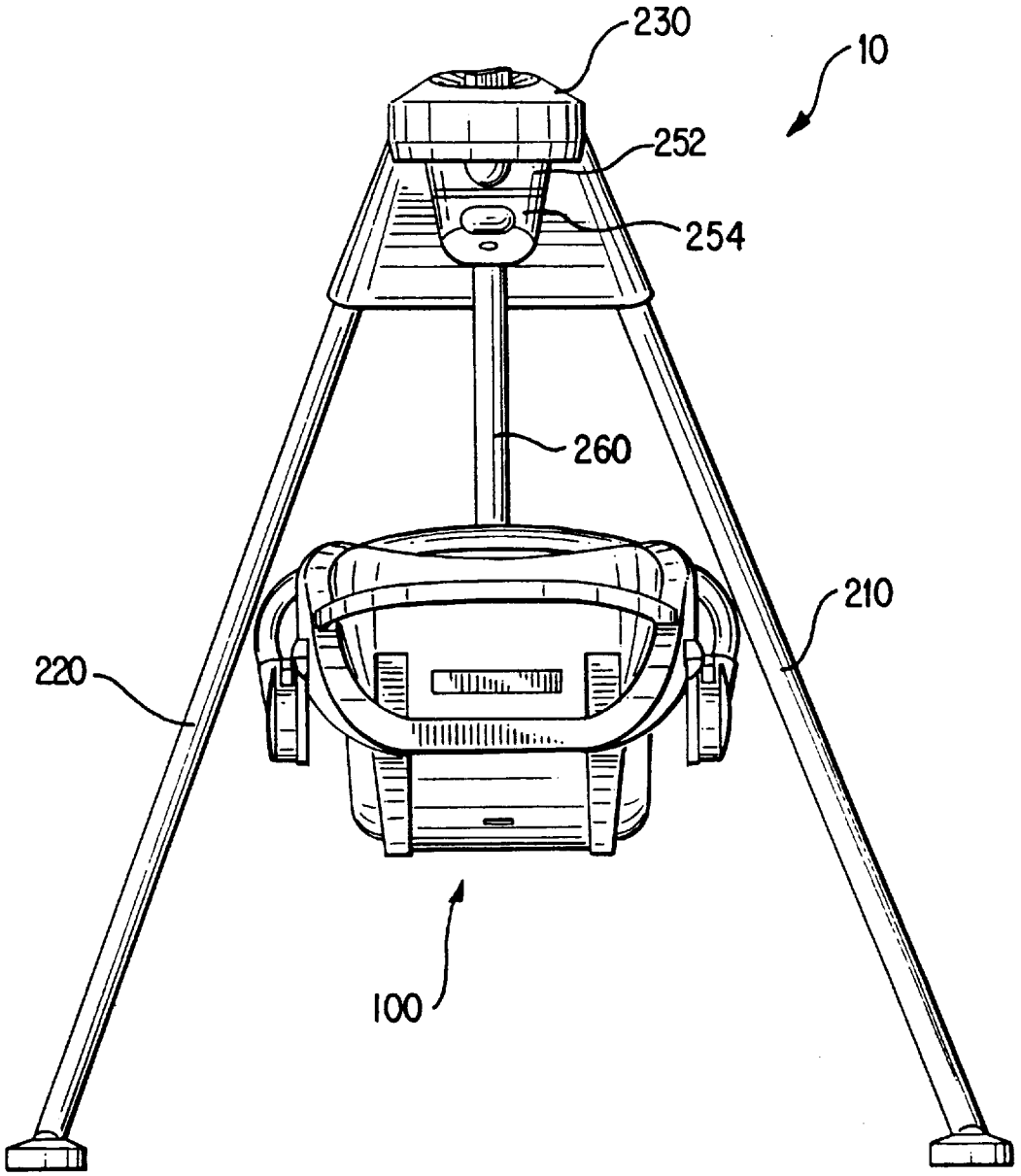
Figure 1C:
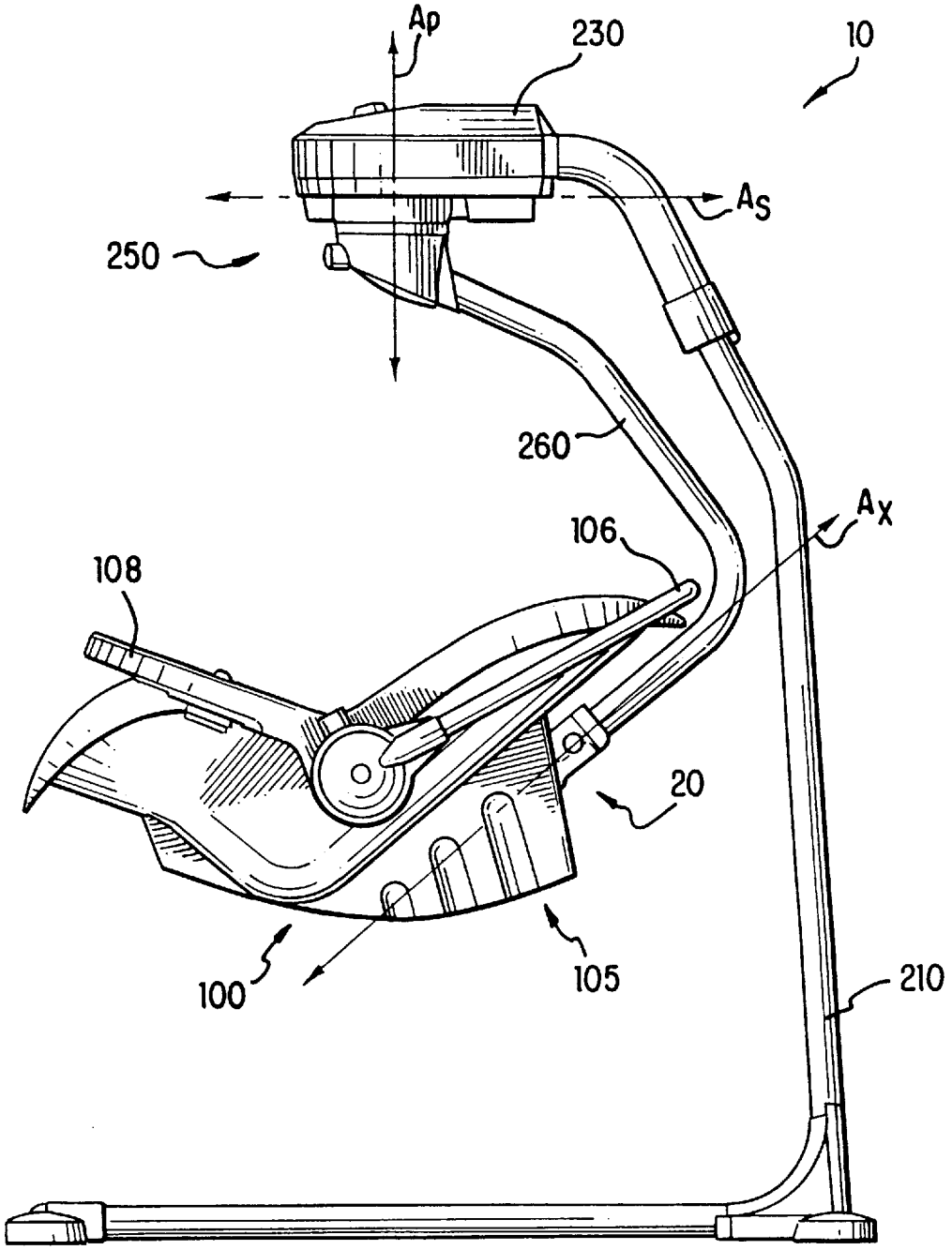

An infant swing 10 incorporating the principles of the present invention is illustrated in FIG. 1. Swing 10 includes a swing frame 200, a seat 100, and a seat-to-frame coupler assembly 20. Swing frame 200 includes left and right C-shaped legs 210; 220 coupled at their upper ends by upper housing 230 and angling downwardly and outwardly to their lower ends. (For purposes of reference herein, left and right, up and down, top and bottom, front and back are defined from the perspective of a child seated in seat 100 with the swing arm arranged in the cradle position, unless otherwise specified or apparent from the context.) Upper housing 230 encloses a drive assembly (not shown), which includes a battery powered motor. The drive assembly supplies motive power to a coupler assembly 250 to rock the coupler assembly about a horizontal swing axis $A_s$ lying in the swing's plane of symmetry (running front to back). Coupler assembly 250 has an upper portion 252 and a lower portion 254 pivotable with respect to upper portion 252 about a vertical pivot axis $A_p$ through a 180° range of angular motion bounded by a right-facing swing position and a left facing swing position and having a central cradle position.

Figure 2A:
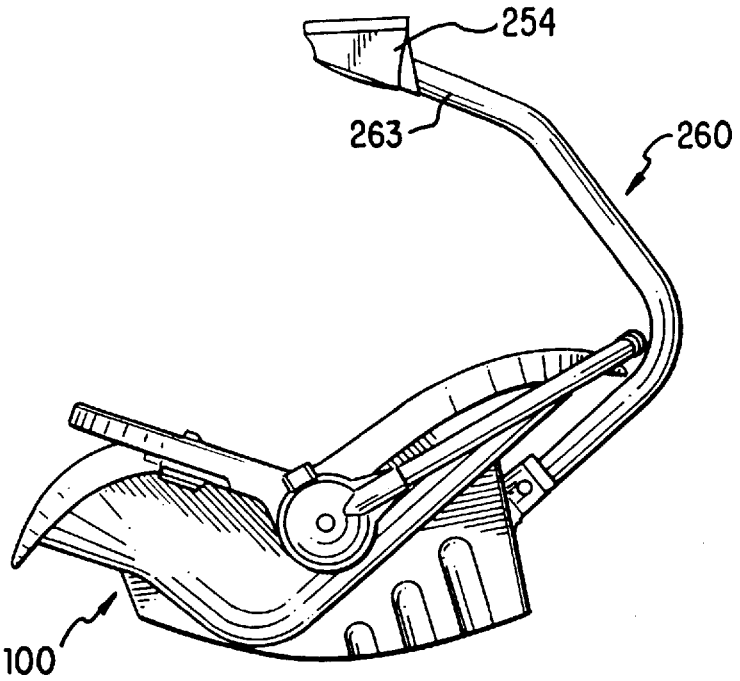
FIGS. 2A and 2B are side views of the seat and swing arm with the seat in reclined and upright positions, respectively.
Figure 2B:
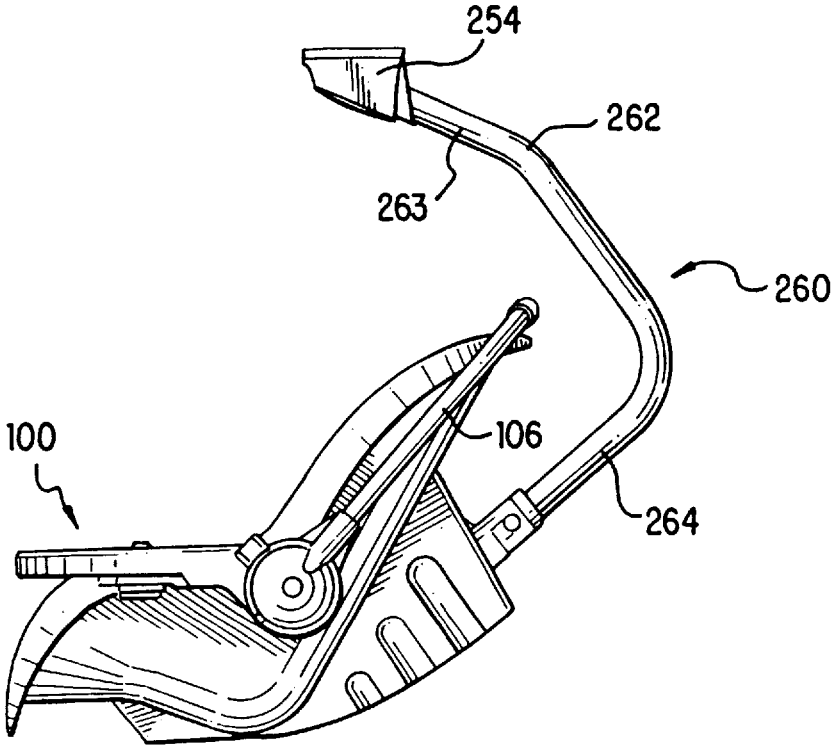

As shown in greater detail in FIGS. 2A and 2B, C-shaped swing arm 260 is coupled at upper end 263 of its upper segment 262 to lower portion 254 of coupler assembly 250. Lower segment 264 of swing arm 260 has a longitudinal slide axis $A_x$, and is attached at its lower, coupler end 266 to seat-to-frame coupler assembly 20. Coupler end 266 has a tube portion 266A and a transverse rod 267 pressed through a pair of transverse holes formed in tube portion 266A.

Seat 100 (illustrated for clarity without the conventional covering soft goods) is a conventional infant seat, L-shaped in longitudinal cross section, and U-shaped in lateral cross-section, with an inner, infant seating surface 102 that has a seat portion 103 and a back portion 104, and an outer surface 105. Seat 100 includes a U-shaped handle 106 pivotably coupled at the ends of the U to opposite sides of the seat for selective pivoting between a carry position in which the handle is approximately perpendicular to back portion 104, a stowed position near the upper end of the seat (shown in FIG. 1), and a kickstand position behind the upper end of the seat. Seat 100 also includes a pivoting tray 108.

Figure 3:
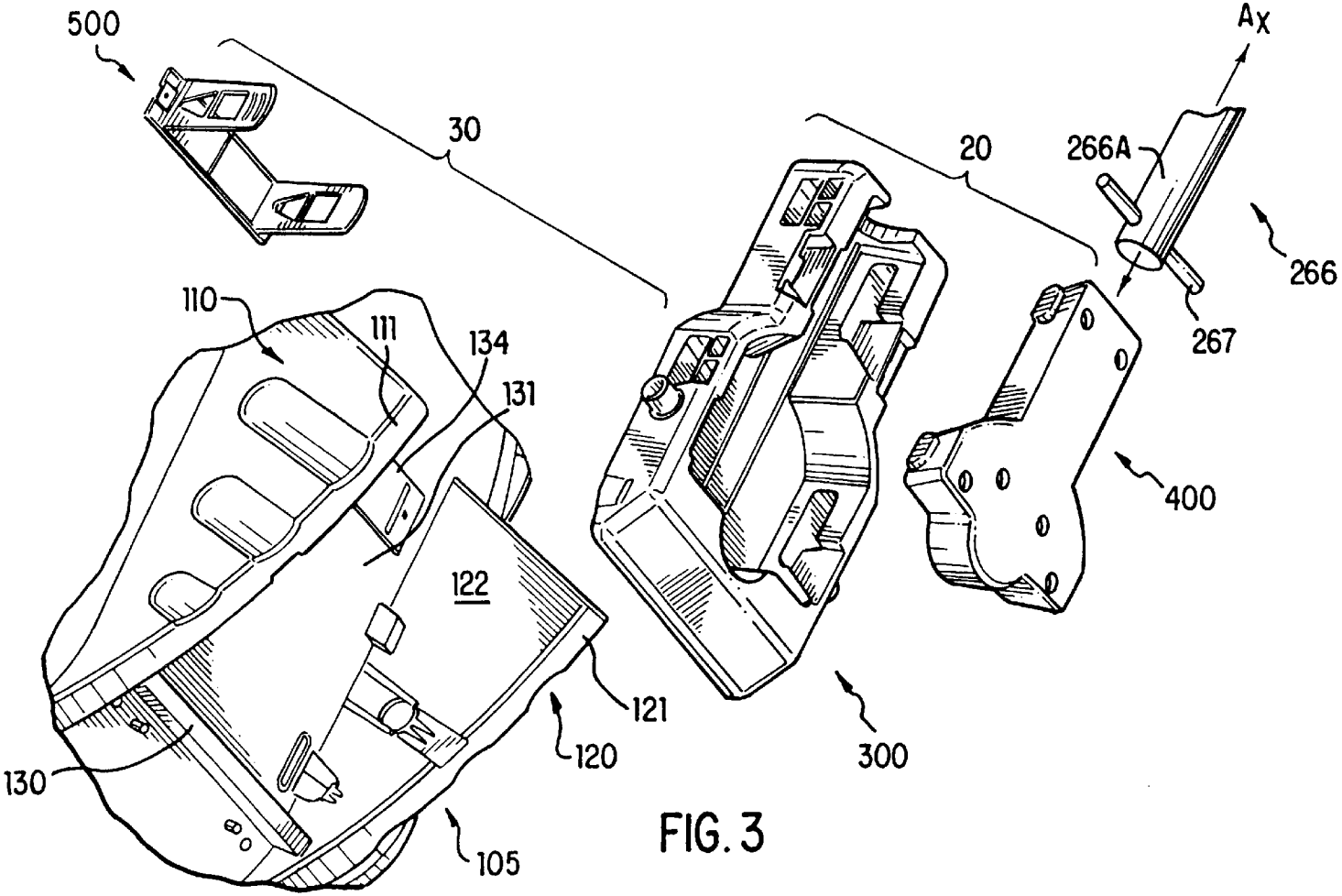
FIG. 3 is an exploded view of the seat, swing arm, seat-to-swing coupler assembly, and seat pivot assembly of FIG. 1.
Figure 4A:
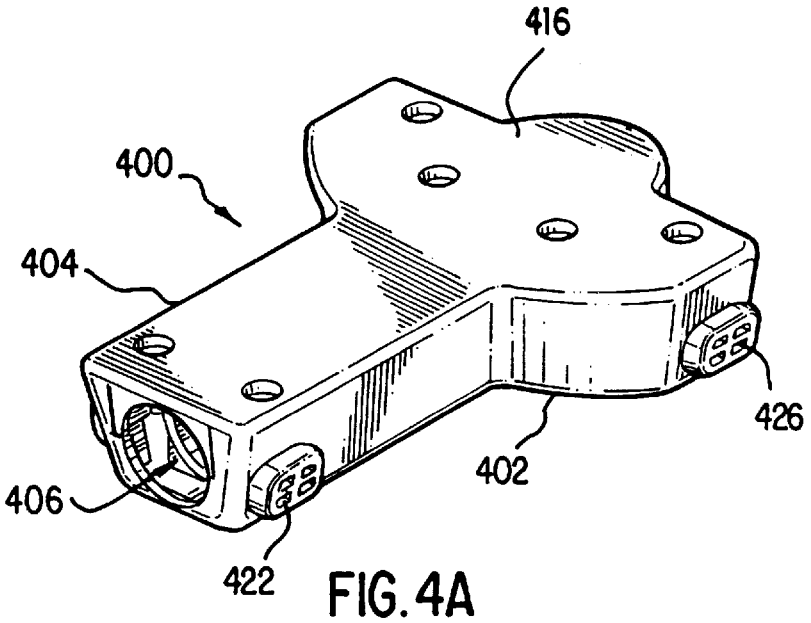
FIGS. 4A–F are front, bottom perspective, rear, top perspective, top plan, side elevation, and rear, bottom and front, top exploded views of the connector of FIG. 3.
Figure 4B:
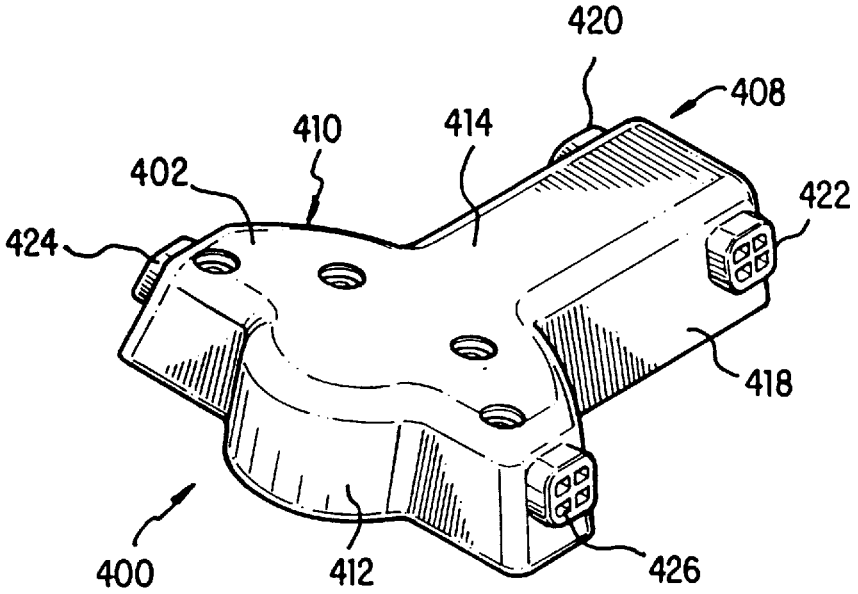
Figure 4C:
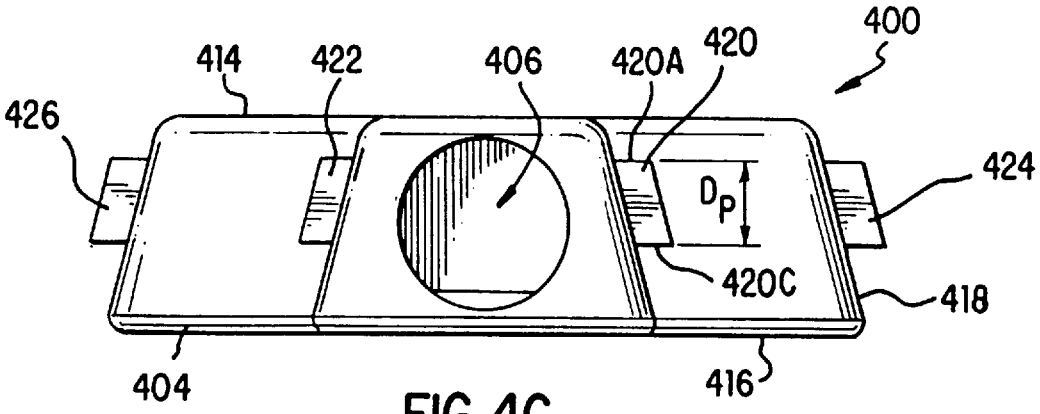
Figure 4D:
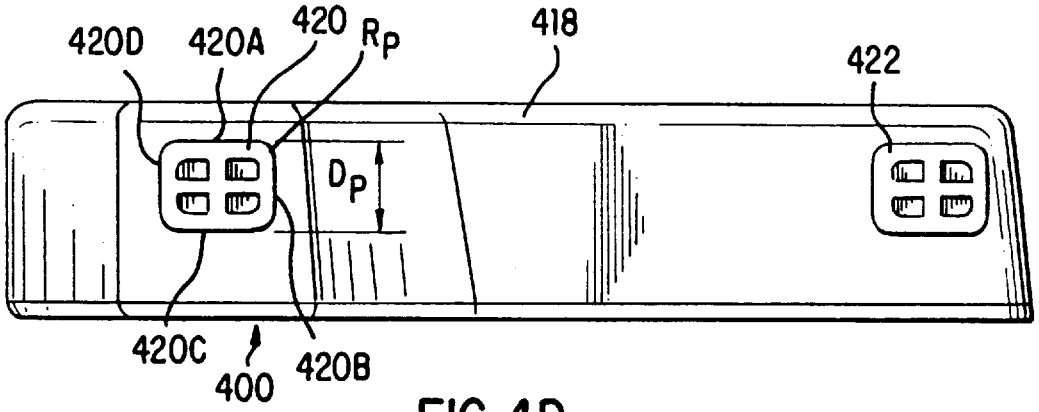
Figure 4E:
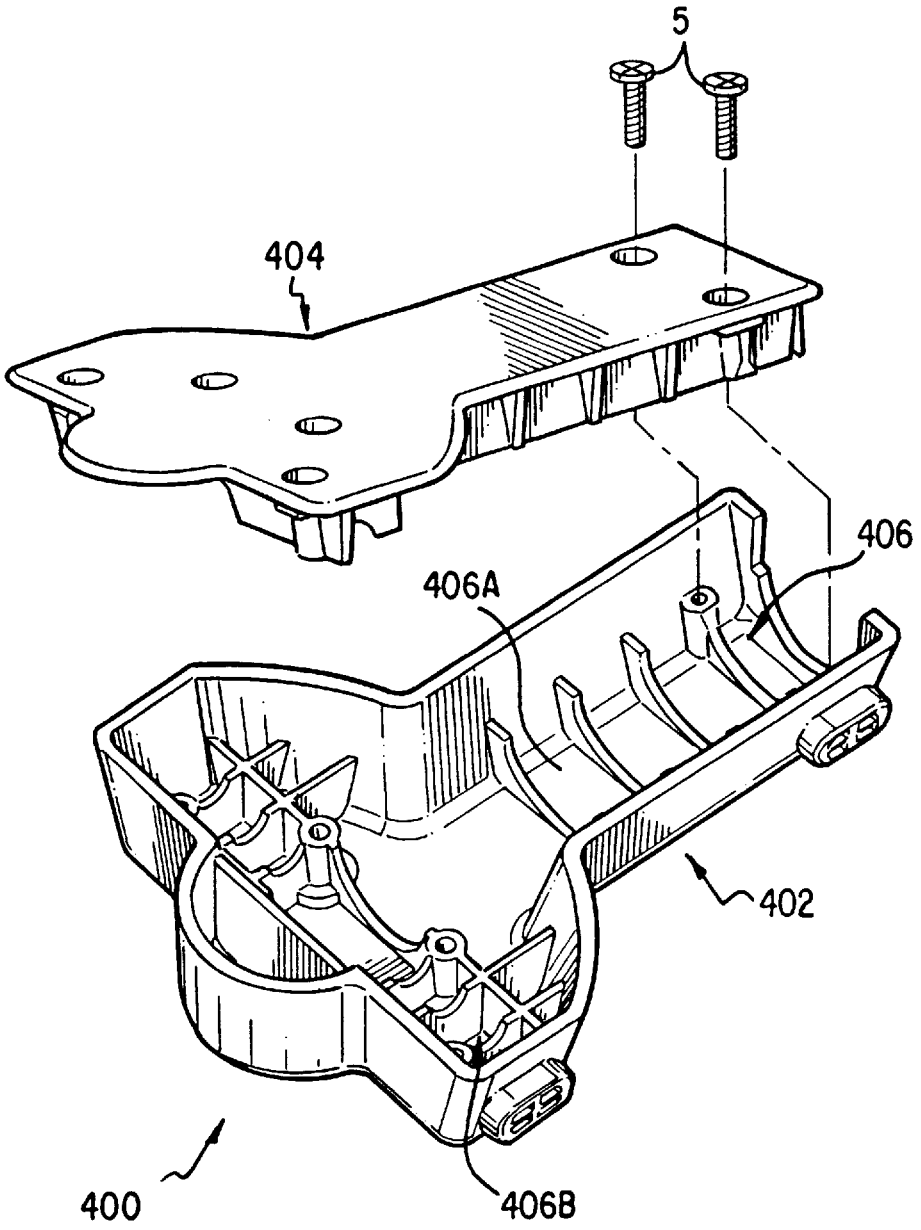
Figure 4F:
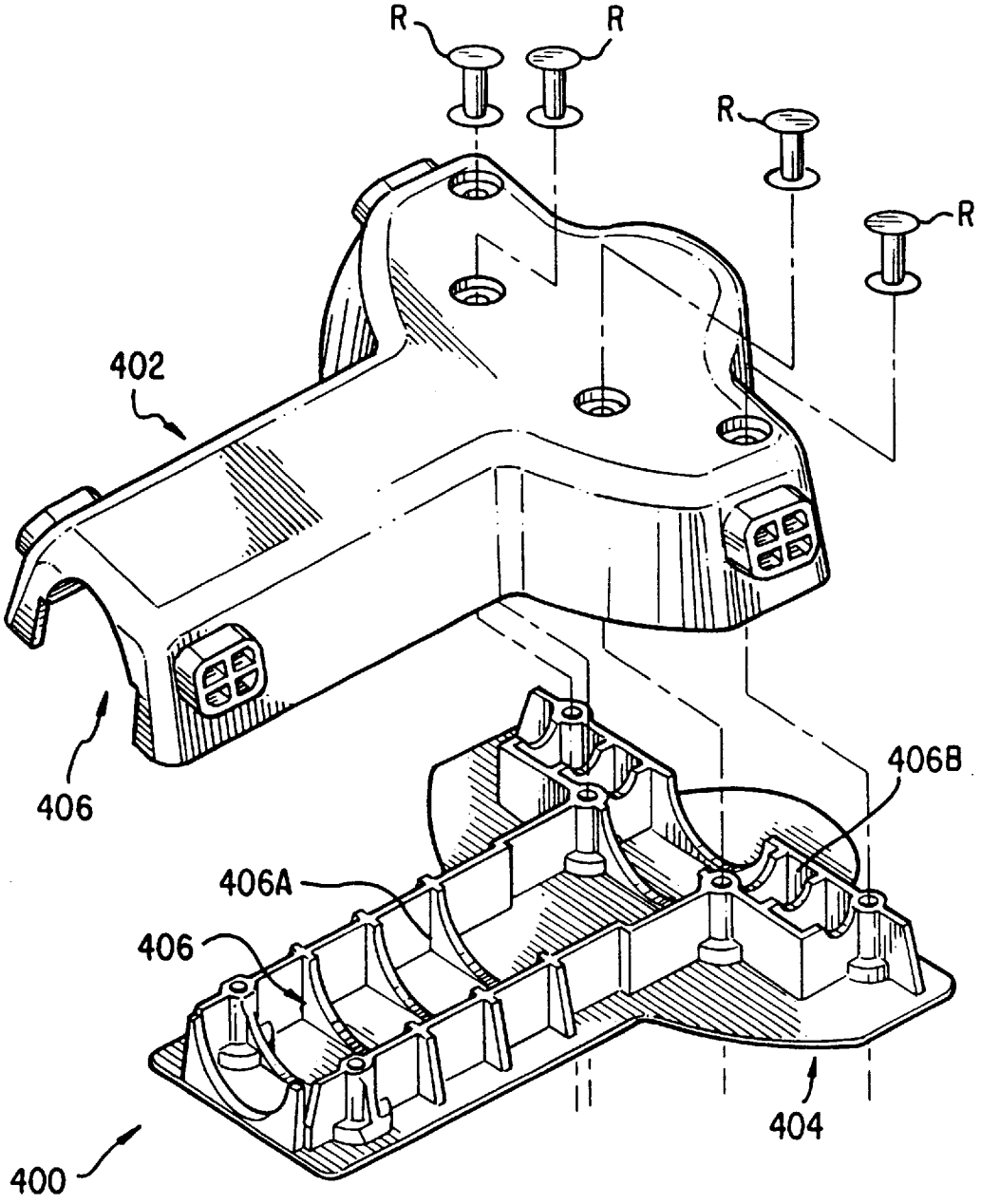

With reference to FIGS. 3 and 4A, seat 100 further includes left and right rocker rails 110, 120 depending downwardly from outer surface 105. Left and right rocker rails 110, 120 have arcuate ground-contacting surfaces 111, 121 and generally planar laterally inwardly facing inner sidewalls 112, 122, respectively. Transverse rib 130 terminates at its left and right ends at inner sidewalls 112, 122. Inner sidewalls 112, 122 and transverse rib 130 bound the left, right, and lower edges, respectively, of a mounting area 131 of outer surface 105. Mounting area 131 receives the seat side of seat-to-frame coupler assembly 20.

As shown in FIG. 3, seat-to-frame coupler assembly 20 includes a swing arm connector assembly 400 coupled to swing arm 26 and a pivot plate 300 pivotally mounted in mounting area 131 and coupleable with connector assembly 400. Seat pivot assembly 30 includes pivot plate 300, various structures on seat 100 in mounting area 131 (described in detail below), and recline latch 500, mounted in mounting area 131 and engageable with pivot plate 300.

As shown in FIGS. 4A–F, connector 400 includes a connector body piece 402 and a rear plate piece 404, joined at their lower ends by four rivets R through mating rivet holes (FIG. 4F), and at their upper ends by two screws S through mating screw holes (FIG. 4E), and defining therebetween a T-shaped swing-arm receiving cavity 406 in which coupler end 266 of swing arm 260 is fixedly received. Cavity 406 has a main portion 406A to receive the tube portion 266A of coupler end 266 and a transverse portion 406B to receive the transverse rod 267 of coupler end 266. This structure gives a high resistance to torque about longitudinal slide axis $A_x$ of swing arm lower segment 264.

Connector 400 is accordingly shaped as an inverted T, with a vertical, post portion 408, a lower, horizontal, transverse portion 410, and a semi-cylindrical protrusion 412 extending downwardly from the center of transverse portion 410. Connector body 402 tapers inwardly from rear surface 416 to front surface 414, producing an angled peripheral sidewall 418. Four generally rectangular mounting posts project laterally outwardly from sidewall 418. Upper left and right mounting posts 420, 422 project from the left and right sides, respectively, of post portion 406, while lower left and right mounting posts 424, 426 project outwardly from the left and right ends, respectively of transverse portion 408. Since all of the posts have essentially identical geometries, only upper left mounting post 420 is described in detail. Post 420 has substantially parallel front and rear surfaces 420A, 420C spaced by a front-to-rear post depth $D_p$, and parallel bottom and top surfaces 420B, 420D. All corners between these surfaces are radiused with radius $R_p$.

Figure 5A:
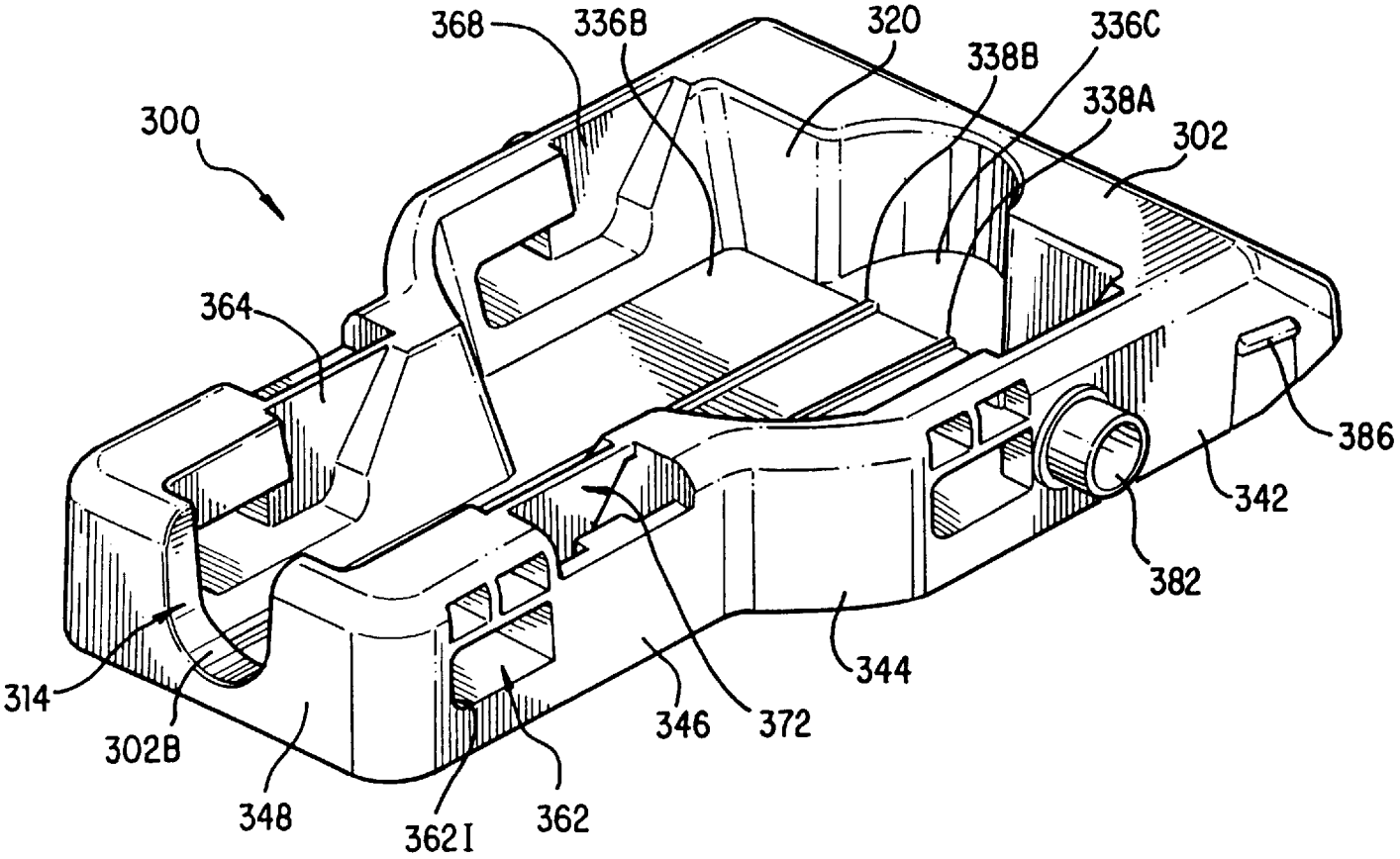
FIGS. 5A–F are rear, top perspective, front, bottom perspective, rear, front, top, and side views of the pivot plate of FIG. 3.
Figure 5B:
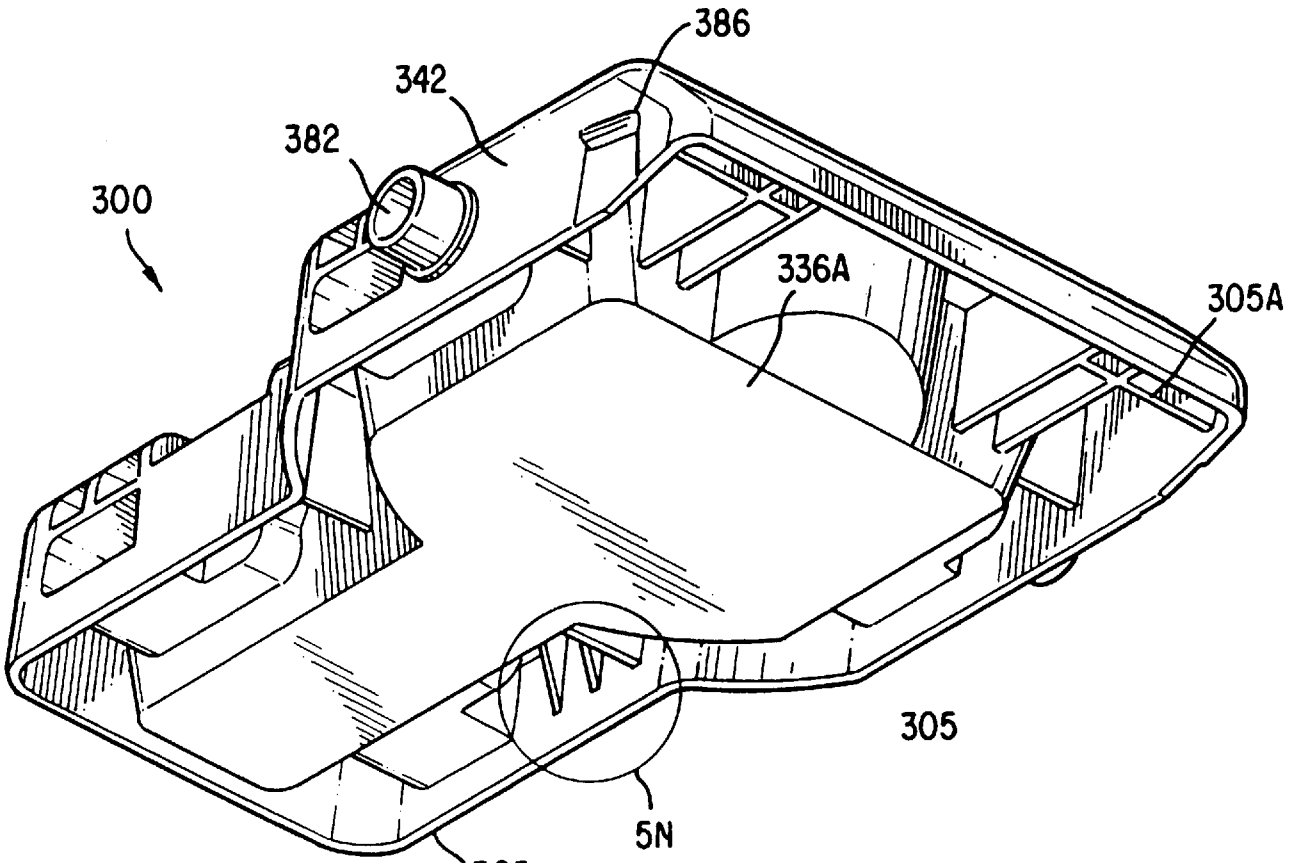
Figure 5C:
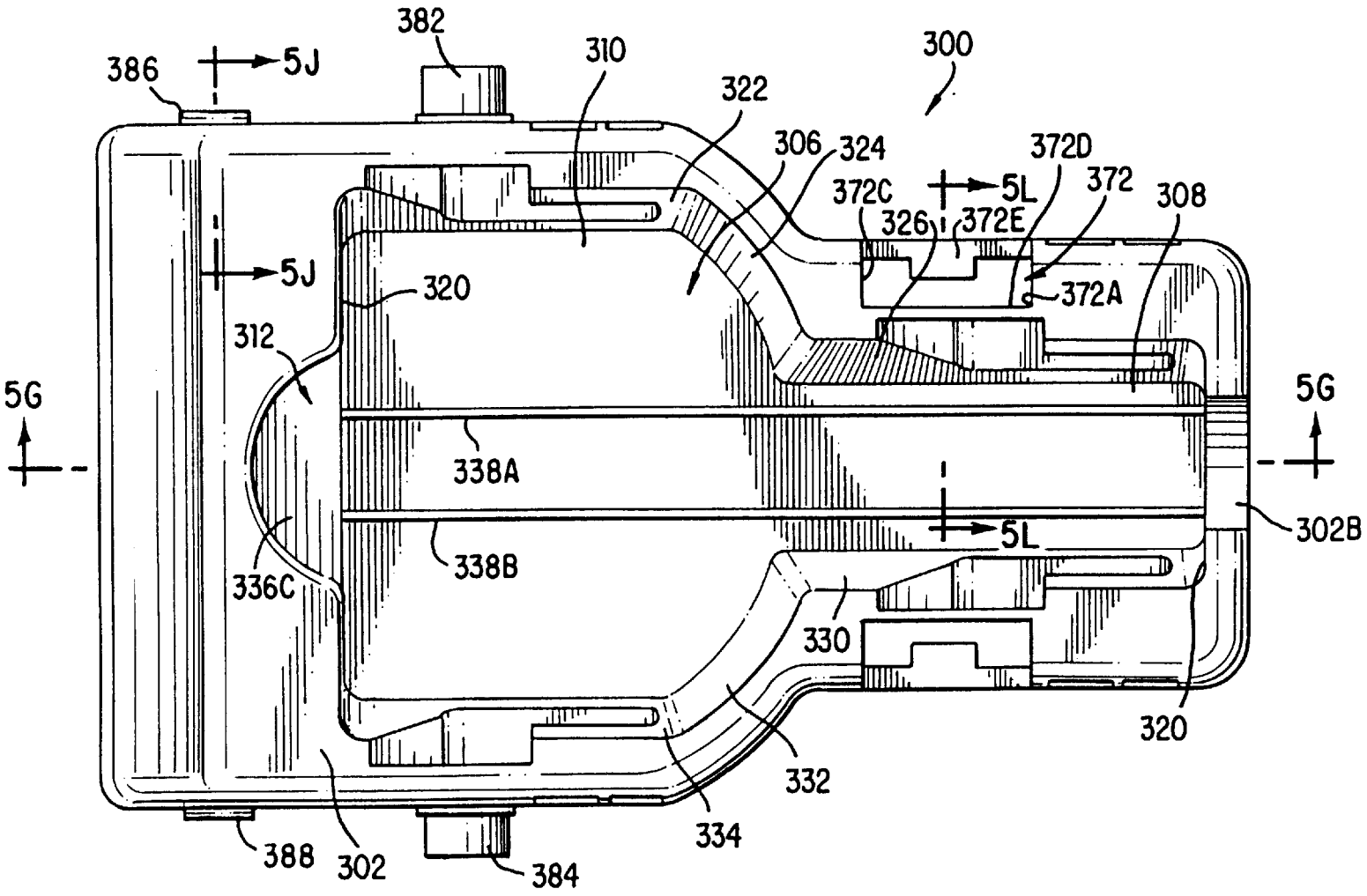
Figure 5D:
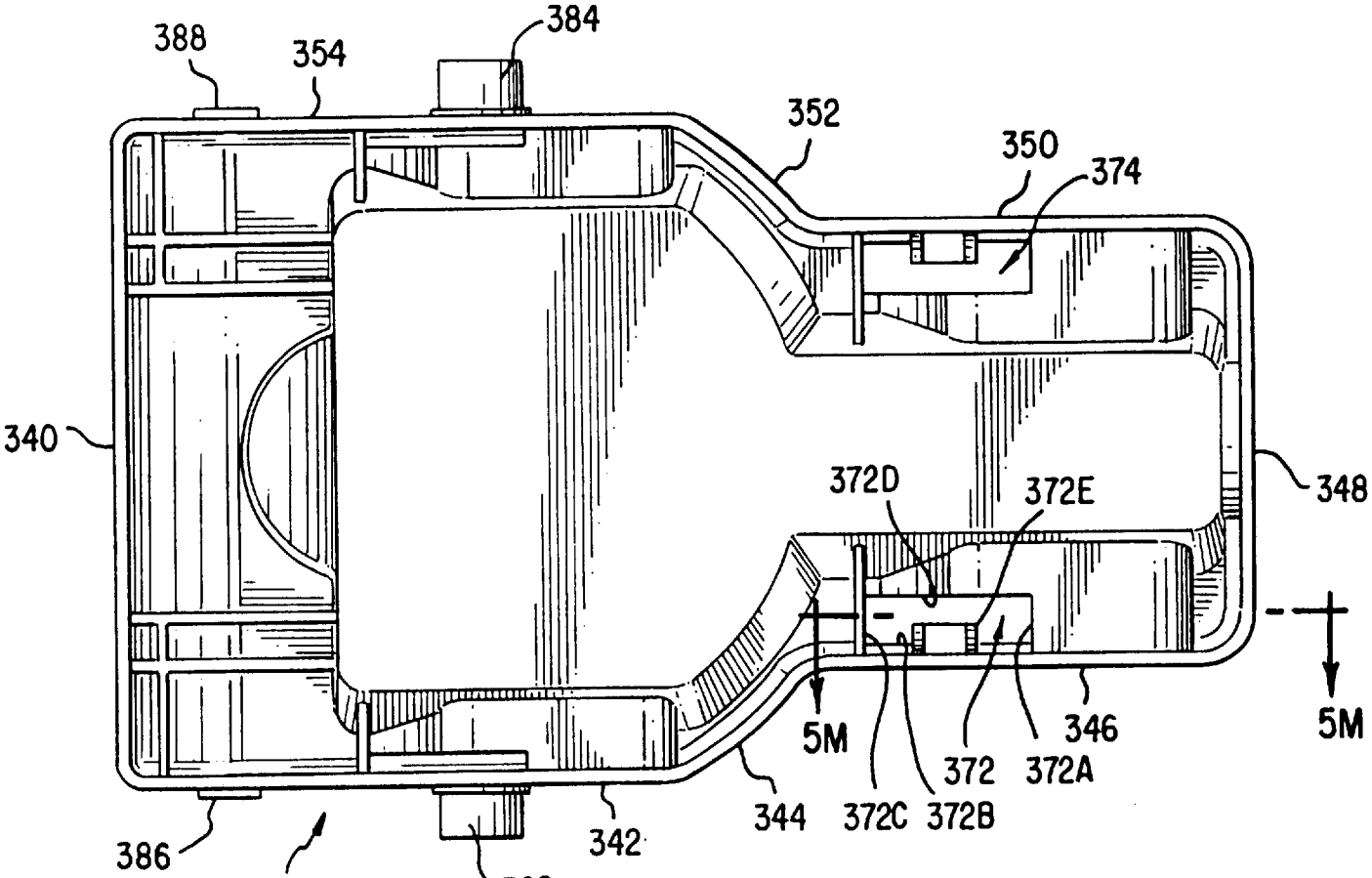
Figure 5E:
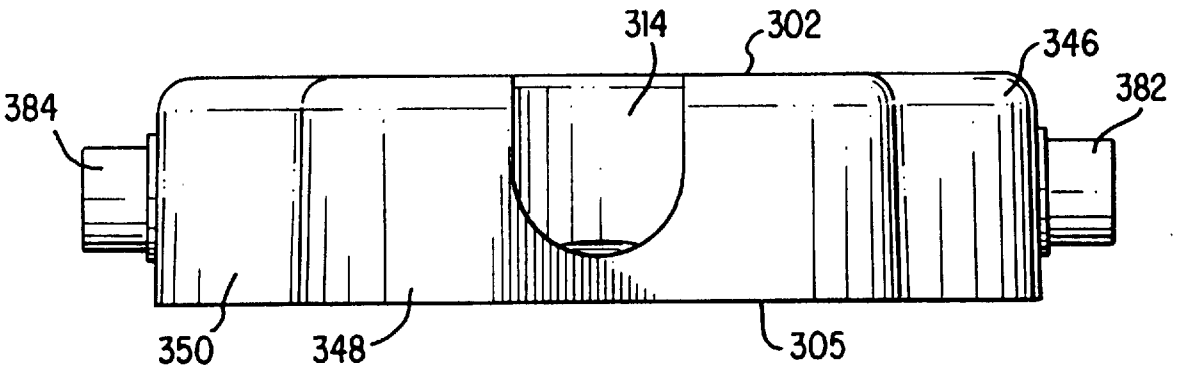
Figure 5F:
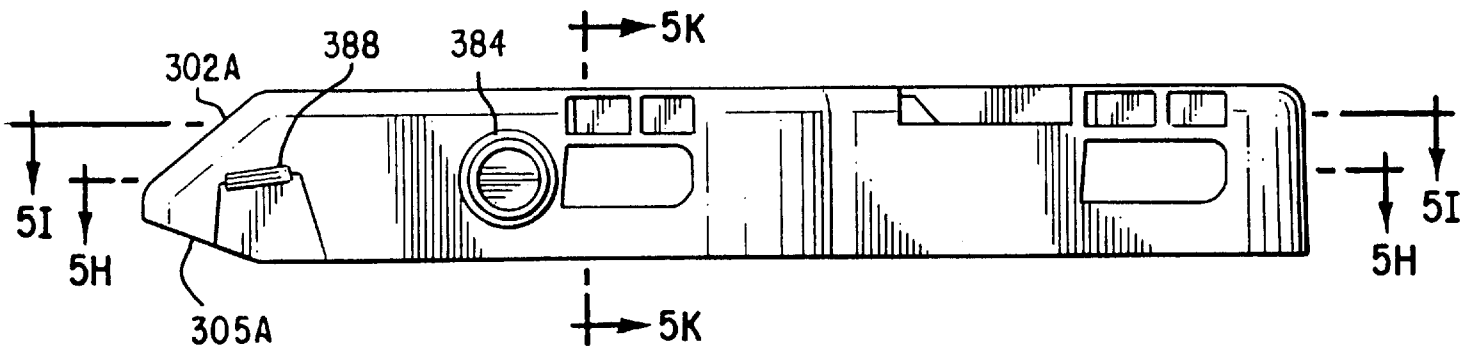
Figure 5G:
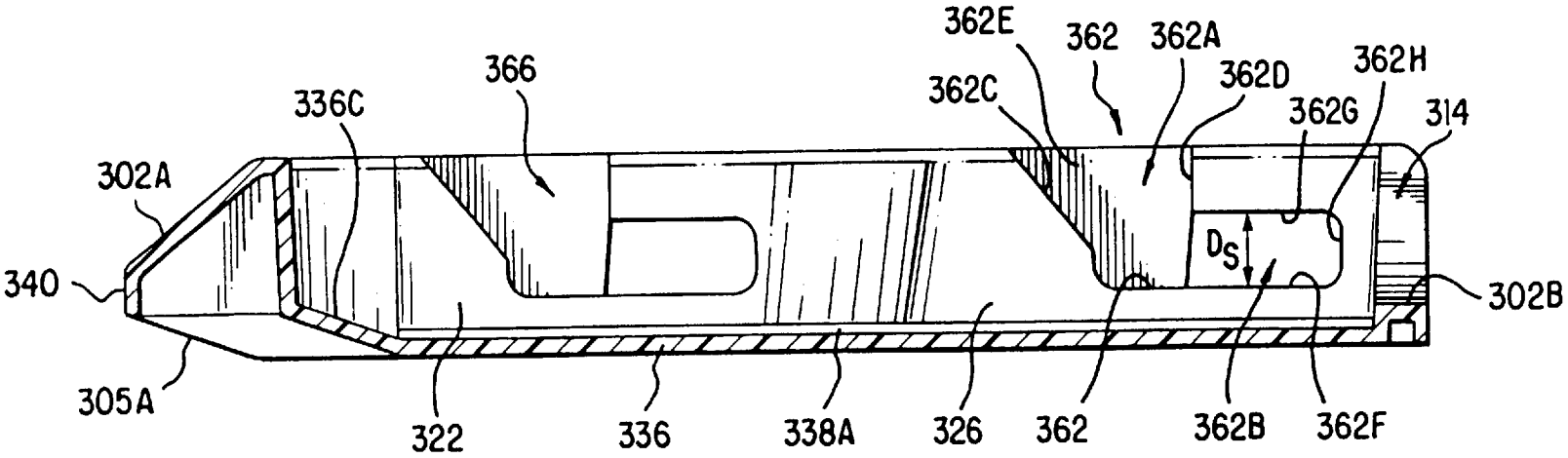
FIG. 5G is a longitudinal cross-section of the pivot plate taken along line 5G—5G of FIG. 5C.
Figure 5I:
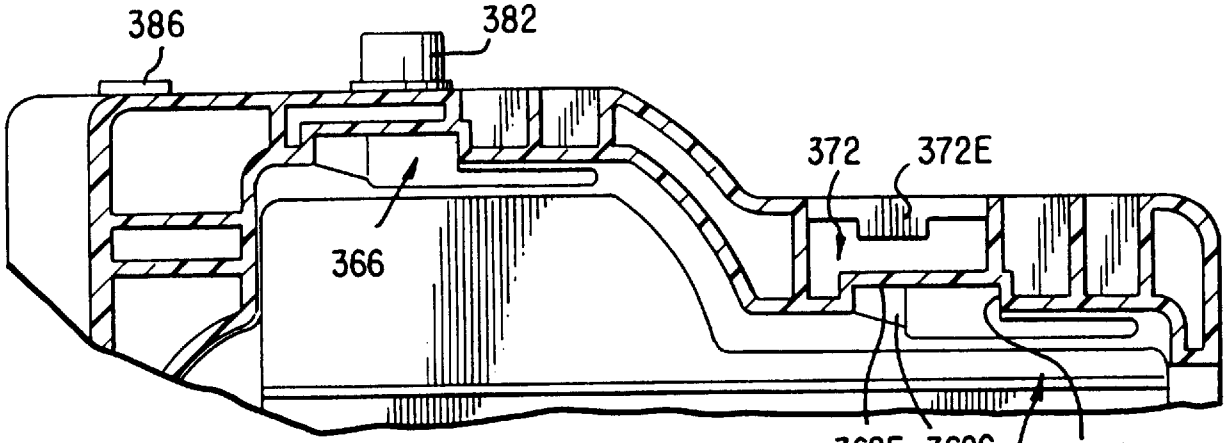
FIGS. 5H, 5I, and 5L are partial cross-sectional views of the pivot plate taken along lines 5H—5H, 5I—5I, and 5L—5L, respectively, of FIG. 5F.
Figure 5H:
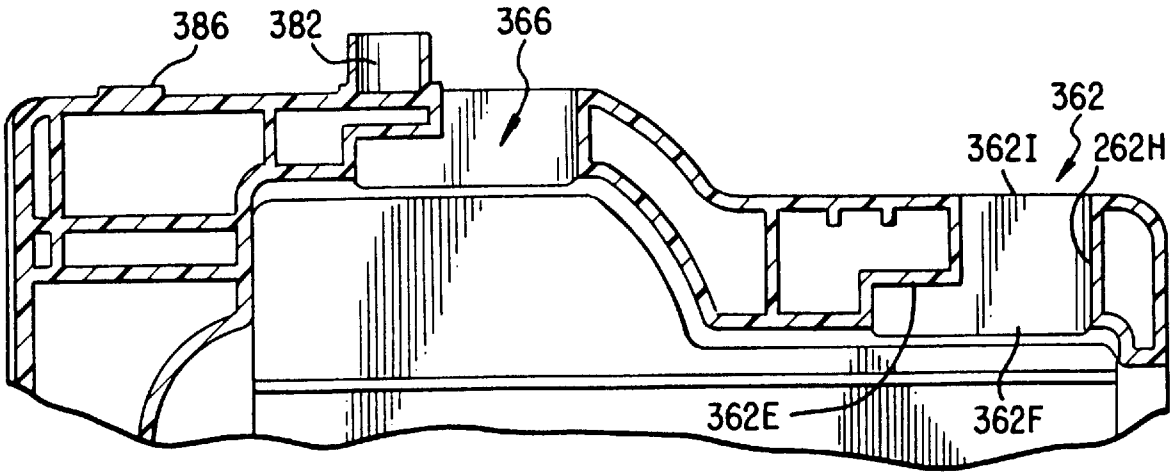
Figure 5K:
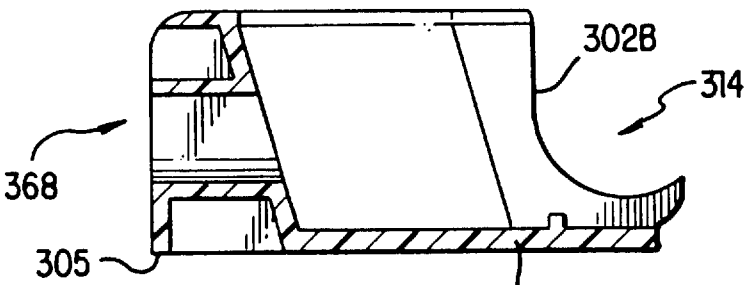
FIGS. 5J and 5K are partial cross-sectional views of the pivot plate taken along lines 5J—5J and 5K—5K, respectively, of FIG. 5C.
Figure 5M:
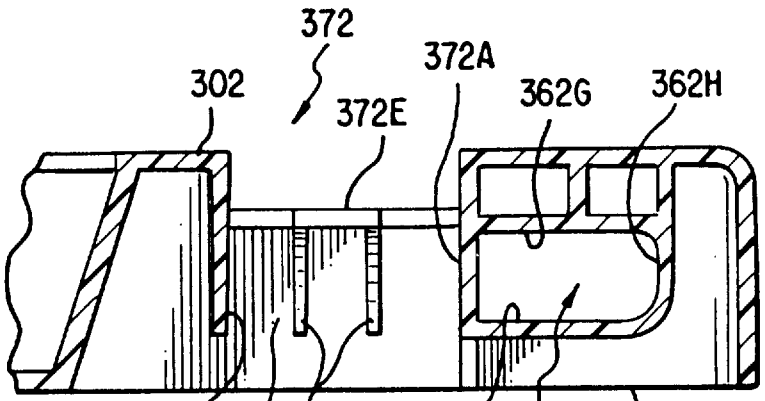
FIG. 5M is a partial cross-sectional view of the pivot plate taken along line 5M—5M of FIG. 5D.
Figure 5J:
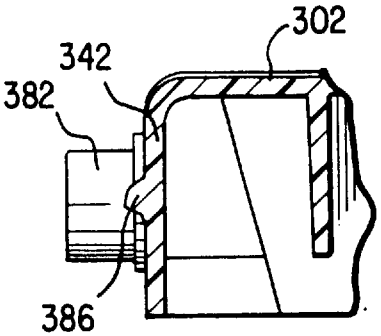
Figure 5L:
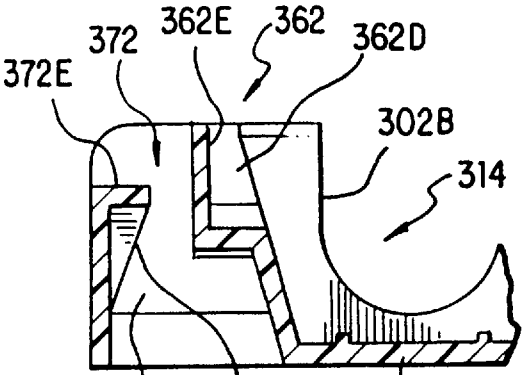
Figure 5N:
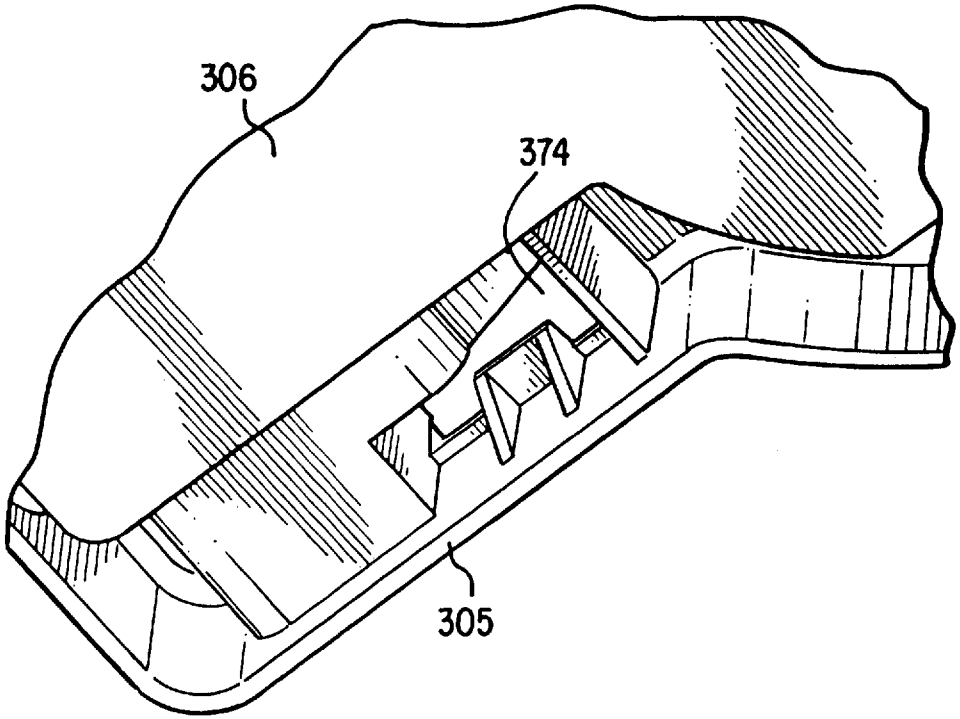
FIG. 5N is a detail view of the right upright latch passage of FIG. 5B.

As shown in FIGS. 5A–N, pivot plate 300 has a rear wall 302 with a forwardly-depending inner peripheral sidewall 303 terminating at a front wall 336 and defining therewith a generally T-shaped receiving cavity 306, and an outer peripheral sidewall 304 depending forwardly from rear wall 302 and terminating in a front rim 305 substantially coplanar with front surface 336A of front wall 336.

Receiving cavity 306 has a post portion 308, a transverse portion 310, and a protrusion 312, corresponding generally in shape to the post portion 408, transverse portion 410, and protrusion 412, respectively, of swing arm connector 400. A pair of longitudinal left and right slide ribs 338A and 338B, respectively, project rearwardly from the rear surface 336A of front wall 336 and extend substantially the entire length of receiving cavity 306. Protrusion surface 336C of front wall 336 slopes slightly upwardly and rearwardly. Inner peripheral sidewall 303 includes a bottom segment 320, (progressing clockwise in FIG. 5C) a lower left side segment 322, a left shoulder segment 324, an upper left side segment 326, a top segment 328, an upper right side segment 330, a right shoulder segment 332, and a lower right side segment 334. Outer peripheral sidewall 304 correspondingly includes a bottom segment 340, (progressing counterclockwise in FIG. 5D) a lower left side segment 342, a left shoulder segment 344, an upper left side segment 346, a top segment 348, an upper right side segment 350, a right shoulder segment 352, and a lower right side segment 354.

Rear wall 302 and front rim 305 are generally parallel, with two exceptions. First, at lower portion 307 of pivot plate 300, lower portion 302A of the rear wall and stop portion 305A of the front rim taper together in a wedge shape. Second, at upper portion 309 of pivot plate 300, rear wall 302 is recessed forwardly in a semi-cylindrical swing arm receiving portion 302B, defining a swing arm receiving recess 314 having a diameter slightly larger than the outside diameter of lower end 263 of swing arm 260.

Projecting laterally outwardly from outer peripheral sidewall lower left and right side segments 342, 354 are left and right hollow, cylindrical pivot posts 382 and 384; respectively. Also projecting laterally outwardly from outer peripheral sidewall lower left and right side segments 342, 354 are wedge-shaped left and right upright latch projections 386 and 388, respectively.

Recessed laterally outwardly from inner peripheral sidewall lower left and right side segments 322, 334 are lower left and right L-shaped slots 366 and 368, respectively. Similarly, recessed laterally outwardly from inner peripheral sidewall upper left and right side segments 326, 330 are upper left and right L-shaped slots 362 and 364, respectively. Since each of the slots 362, 364, 366, and 368 have substantially the same configuration, only slot 362 is described in detail.

Slot 362 has a forwardly-tapering entry portion 362A terminating at its forward end at the lower end of a seating portion 362B extending upwardly generally parallel to rear wall 302. Entry portion 362A is bounded at its lower side by forwardly and upwardly-sloping guide wall 362C, at its upper side by upper wall 362D, and at its left side by side wall 362E. Seating portion 362B is bounded at its forward side by forward wall 362F, at its rear side by rear wall 362G, at its upper side by stop wall 362H, and at a portion of its left side by side wall 362E. The upper part of seating portion 362B extends outwardly through outer peripheral sidewall 304, terminating at its outer end at aperture 362I in upper left side segment 346. Seating portion 362B has a front-to-rear slot depth $D_s$ slightly larger than post depth $D_p$.

A pair of left and right recline latch passages 372, 374 penetrate rear wall 302 on the laterally outer side of upper left and right slots 362, 364, respectively. Since latch passages 372 and 374 have substantially the same configuration, only left latch passage 372 is described in detail.

Latch passage 372 is bounded at its upper end by upper wall 372A, at its left side by cam wall 372B, and its lower end by lower wall 372C, and at is right side by side wall 372D. A rearwardly-facing recline latch shoulder 372E is formed at the rear end of latch passage 372, and a rearwardly and inwardly sloping latch cam ramp 372F extends from the forward side of the latch shoulder.

The mounting area 131 of seat 100 is illustrated in FIGS. 6A–G. As noted above, mounting area 131 is bounded by left and right inner sidewalls 112, 122 and by transverse rib 130, and has a generally planar mounting wall 132. A rectangular recline latch mounting boss 134 protrudes rearwardly from mounting wall 132 and includes left and right latch arm slots 134A and 134B, respectively.

Inner sidewalls 112, 122 include several structures that cooperate with pivot plate 300 as part of seat pivot assembly 30. These structures include left and right pivot mounts 140, 150, left and right recline stops 160, 170, and left and right upright latches 180, 190. Since each of these pairs of structures are identical, only the left ones will be described in detail.

Figure 6A:
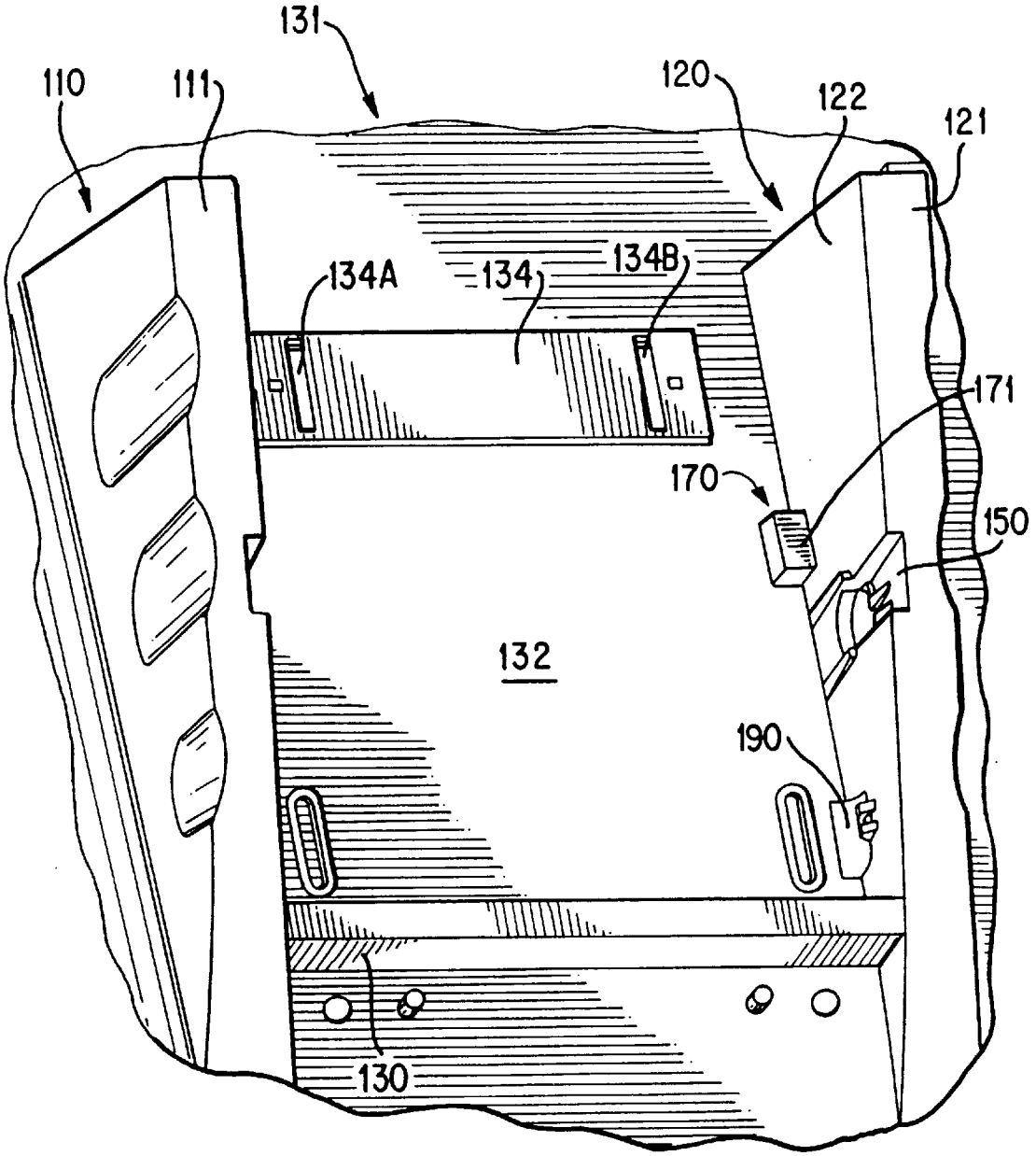
FIGS. 6A and 6B are rear, bottom perspective, and rear views of the seat mounting area the seat of FIG. 3
Figure 6B:
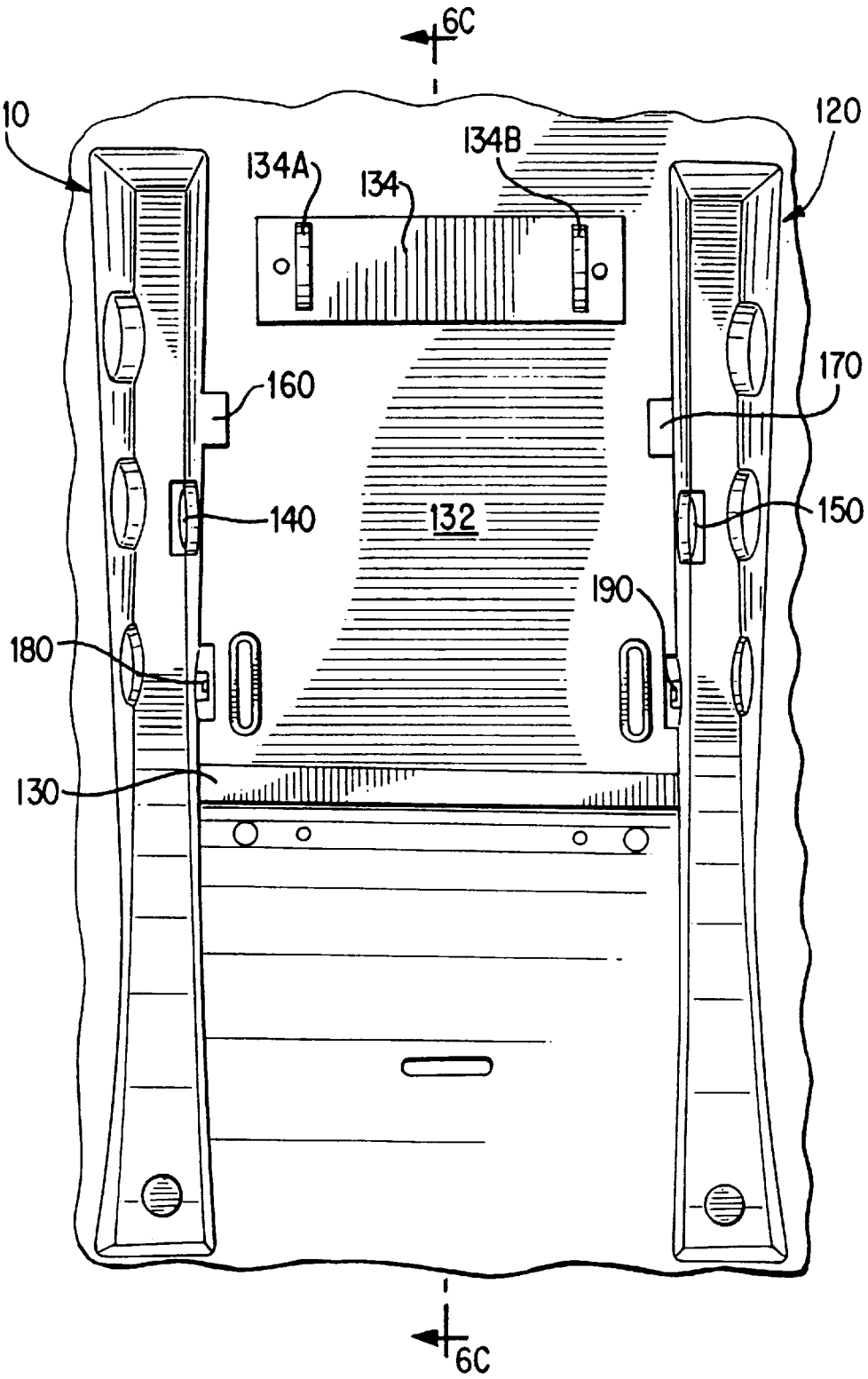
Figure 6C:
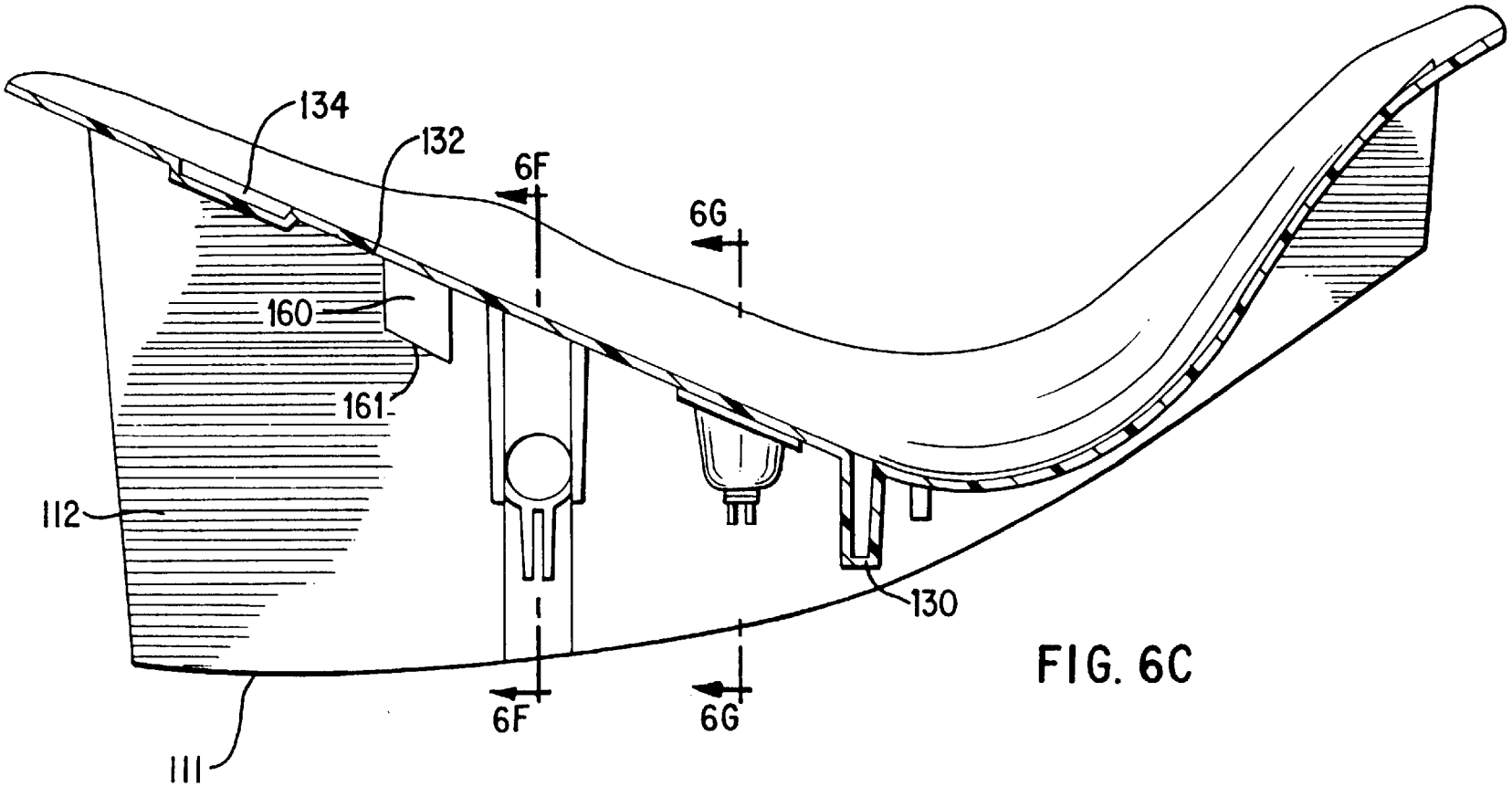
FIG. 6C is a cross-sectional view of the mounting area of the seat, taken along line 6C—6C of FIG. 6B.
Figure 6F:
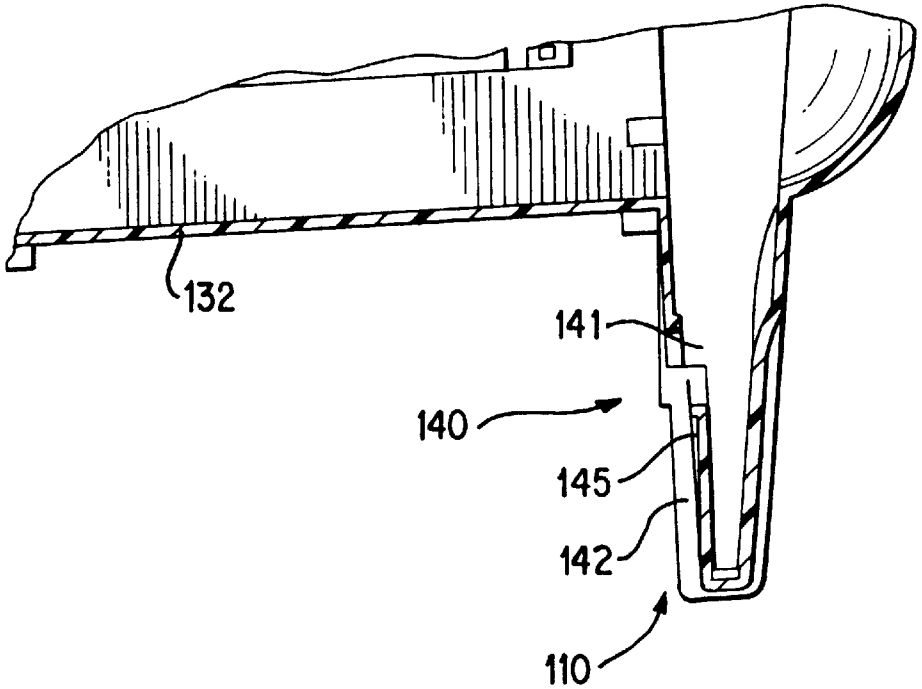
FIGS. 6F and 6G are cross-sectional views of the pivot mount and upright seat latch taken along lines 6F—6F and 6G—6G of FIG. 6C, respectively.
Figure 6D:
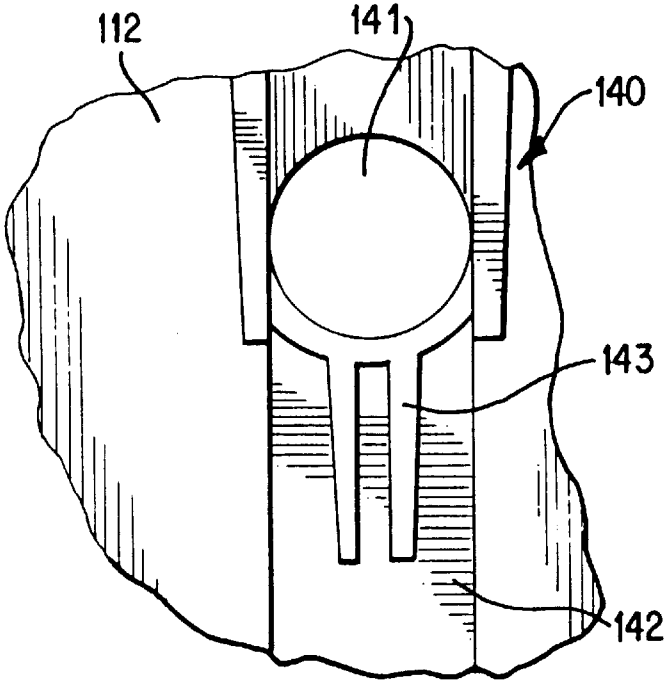
FIGS. 6D and 6E are detail views of the pivot mount and upright seat latch.

Left pivot mount 140 is best viewed in FIGS. 6C, 6D and 6F. It includes a cylindrical pivot passage 141 that penetrates inner sidewall 112 and has an inner diameter slightly larger than outside diameter of pivot plate left pivot post 382. A guide slot 142 is formed in inner sidewall 112 and extends forwardly from ground contacting surface 111 to pivot passage 141. A ribbed guide ramp 143 extends upwardly and inwardly from the surface of guide slot 142 to the rim of pivot passage 141. This structure permits ready insertion of pivot plate left pivot post forwardly along guide slot 142 and into rotatable engagement with pivot passage 141.

Left recline stop 160 is best viewed in FIG. 6C (while identical right recline stop is best viewed in FIG. 6A). Recline stop 160 is formed as a shoulder that projects inwardly from inner sidewall 112 and rearwardly from mounting wall 132, and has a rearwardly-facing stop surface 161 that is generally parallel to mounting wall 132. Right recline stop 170 similarly has a stop surface 171.

Figure 6G:
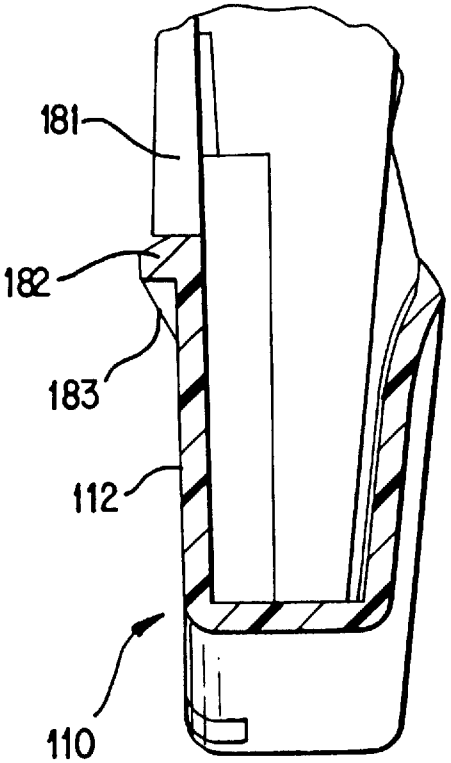
Figure 6E:
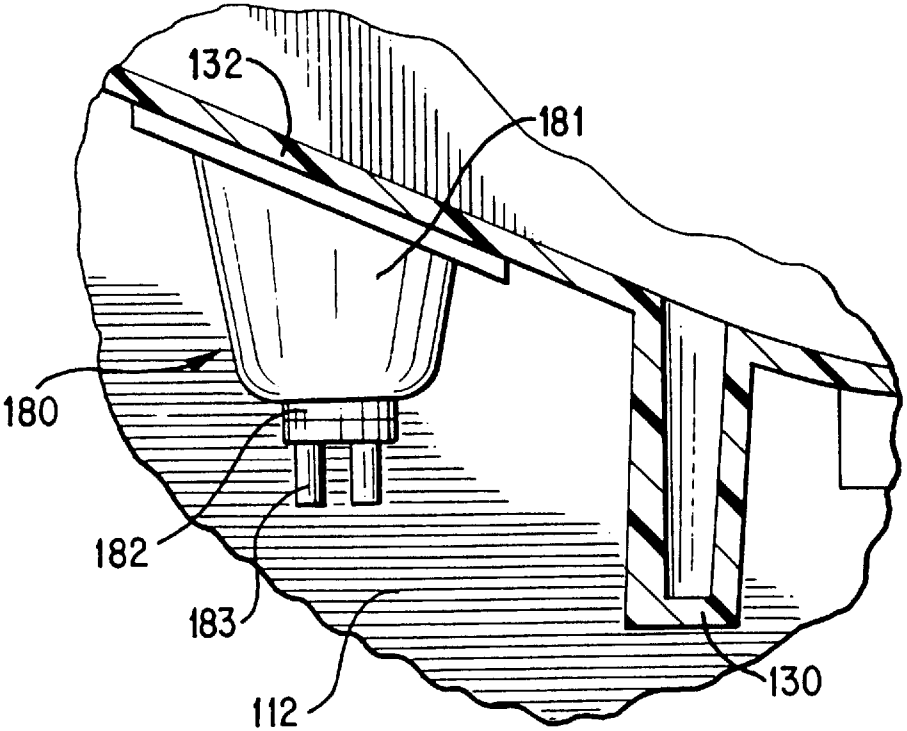

Left upright latch 180 is best viewed in FIGS. 6C, 6E, and 6G. It includes a latch aperture 181 that penetrates inner sidewall 112, a latch shoulder 182 that projects inwardly from the rearward end of aperture 181, and a ribbed latch ramp 183 that slopes inwardly and rearwardly from inner sidewall 112 to the rearward edge of shoulder 182.

Figure 7A:
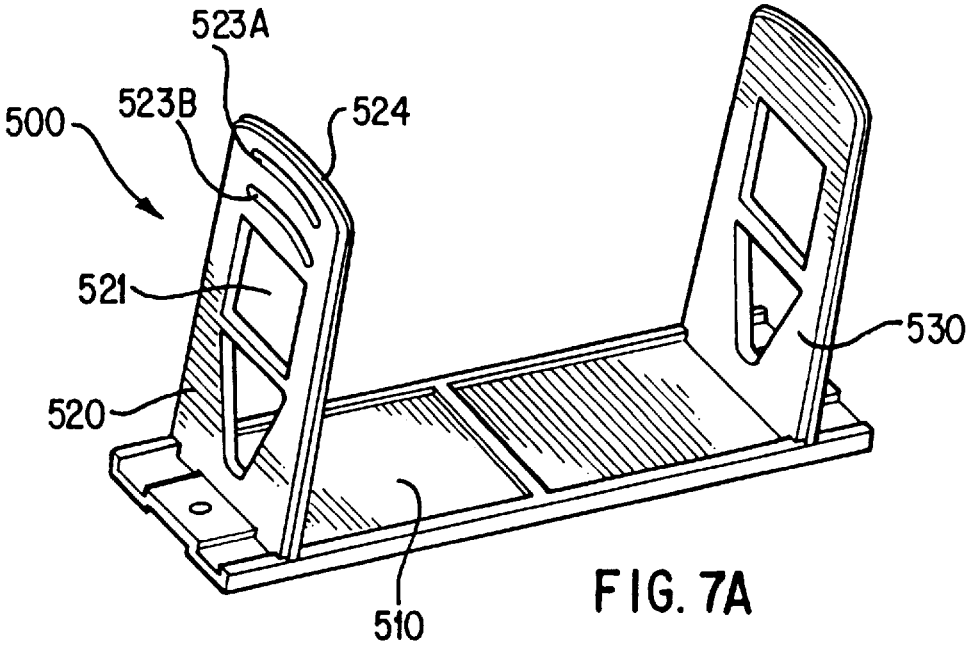
FIGS. 7A and 7B are rear, bottom perspective and front, top perspective views of the recline latch of FIG. 3.
Figure 7B:
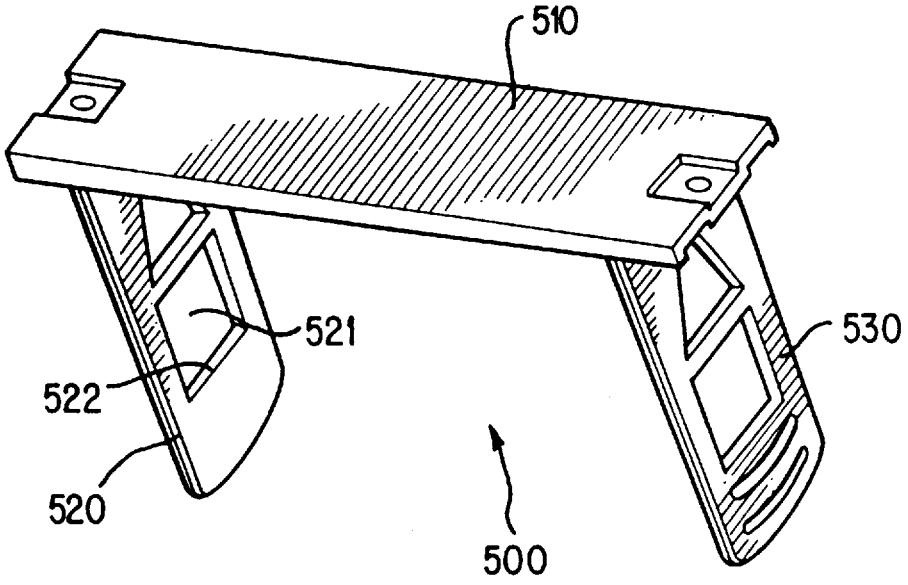

Recline latch 500 is illustrated in FIGS. 7A–B. The latch includes a generally rectangular base 501, and identical, rearwardly-projecting left and right latch arms 520, 530. Latch arm 503 includes a latch aperture 521 with a rear, forwardly-facing latch edge 522. The rear end of left latch arm 520 terminates in a rear edge 524. A pair of arcuate finger grooves 523A, 523B are formed in the outer surface of the rear end of left latch arm 520. Recline latch 500 is mounted in recline latch mounting boss 134 with left and right latch arms 520, 530 projecting rearwardly through left and right latch arm slots 134A, 134B, respectively, and is fastened to boss 134 by rivets (not shown).

The operation of pivot assembly 30 is illustrated with reference to FIGS. 8A–F and 2A–B. Pivot plate 300 is mounted in mounting area 131, with left and right pivot posts 382, 384 mounted in left and right pivot mounts 140, 150. Pivot plate 300 is pivotable about a recline pivot axis $A_r$ extending transversely through the pivot posts, through a range of angular motion bounded at one end by a recline position (FIGS. 2A, 8B) and at the other end by an upright position (FIG. 2B, 8F). The recline position is defined by engagement of front rim 305 of pivot plate 300 with the stop surfaces 161, 171 of left and right recline stops 160, 170. The upright position is defined by engagement of stop portion 305A of front rim 305 with mounting wall 132. The recline angle $\Theta_r$ about the pivot axis $A_r$ (FIG. 8F) between the recline and upright positions is 20°.

Pivot plate 300 is retained in the recline and upright positions by engagement with the recline and upright latches, respectively. As shown in FIG. 8D, when in the recline position, recline latch shoulder 372E is disposed rearwardly of latch edge 522 of left recline latch arm 520, preventing rotation of pivot plate 300 away from recline position. However, if left recline latch arm 160 is flexed inwardly (as shown in phantom in FIG. 8D) such as by application of any inwardly directed force to the outer side of the latch arm by a user's finger pressing inwardly on the finger grooves 523A, 523B, latch edge 522 will be disposed laterally inwardly of recline latch shoulder 372E, allowing rotation of the pivot plate away from the recline position. If pivot plate 300 is rotated from the upright position toward the recline position, left recline latch cam ramp will engage rear edge 524 of left latch arm 520, flexing latch arm 520 inwardly until the pivot plate reaches the recline position and shoulder 372E clears latch edge 522, at which point the latch arm will snap back to its normal position.

Figure 8A:
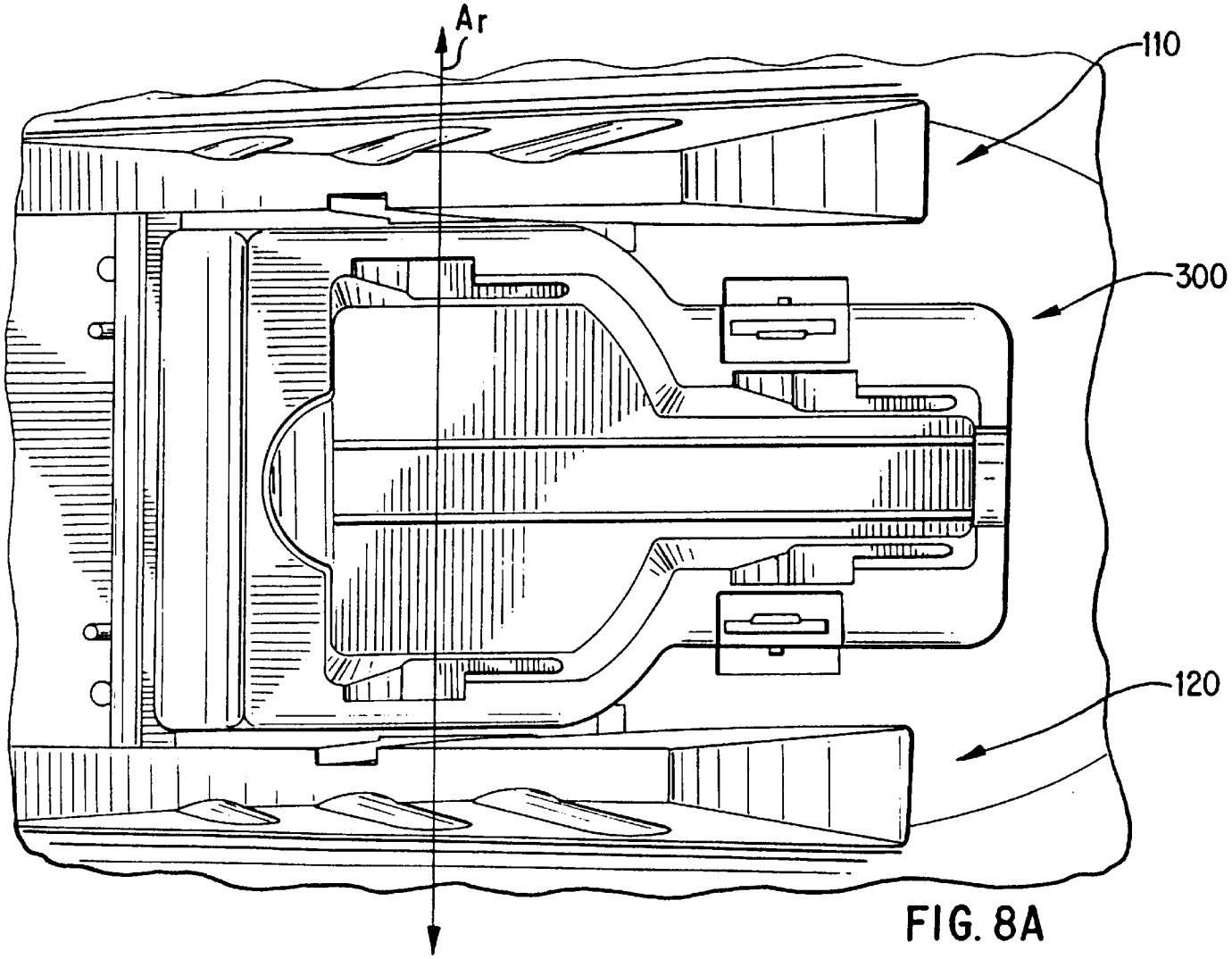
FIGS. 8A and 8B are partial rear and side views of the seat and pivot assembly of FIG. 3 in a recline orientation.
Figure 8B:
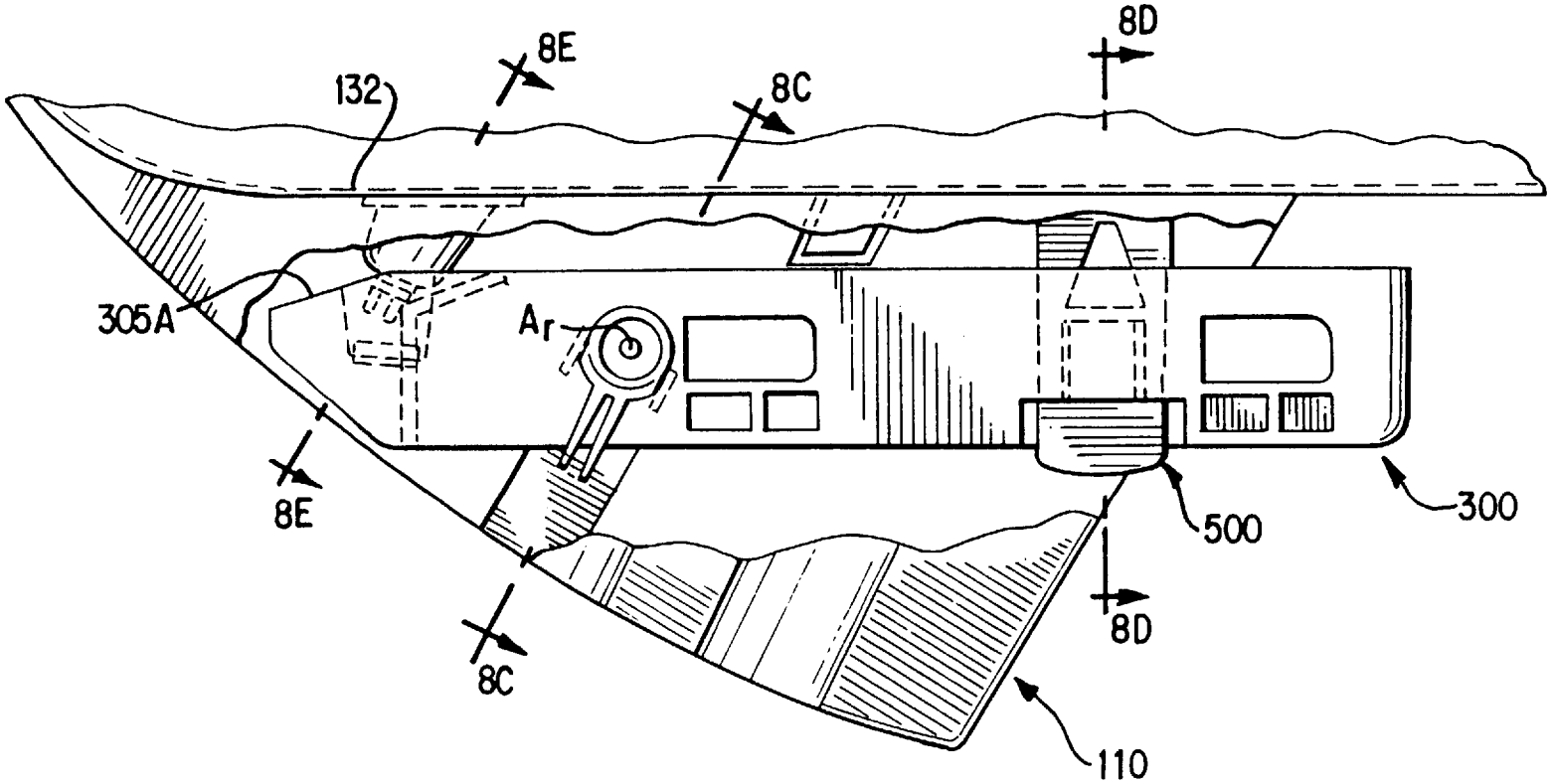
Figure 8C:
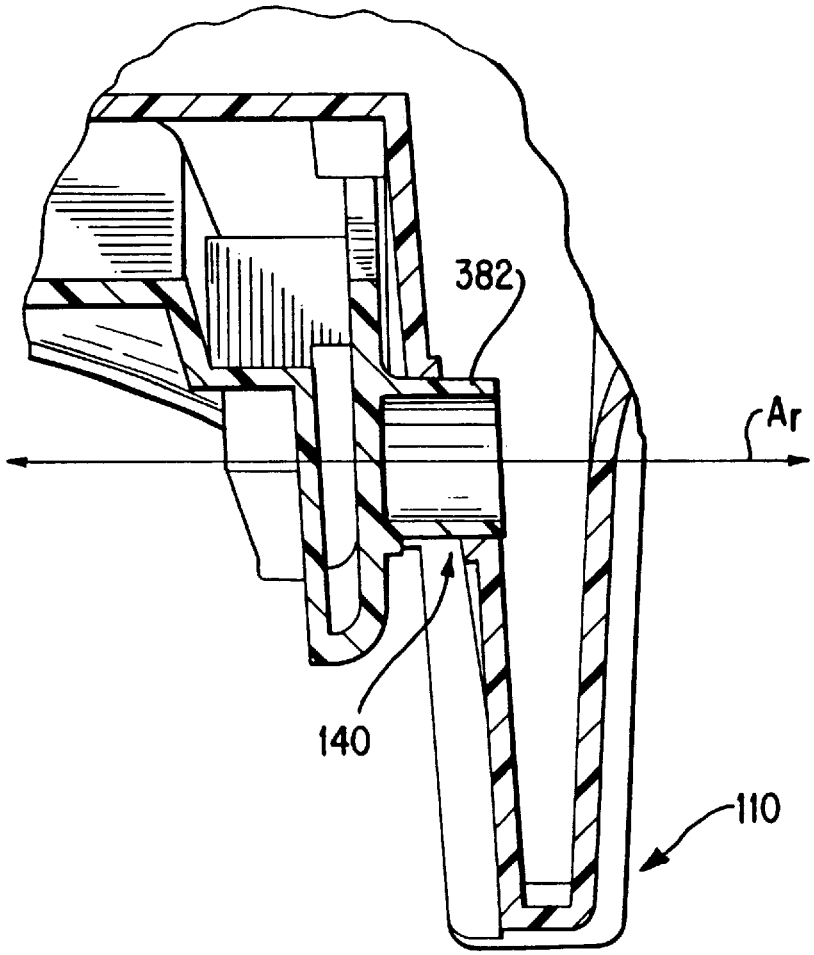
FIGS. 8C, 8D, and 8E are partial cross-sectional views of the seat and pivot assembly taken along lines 8C—8C, 8D—8D, and 8E—8E of FIG. 8B, respectively.
Figure 8D:
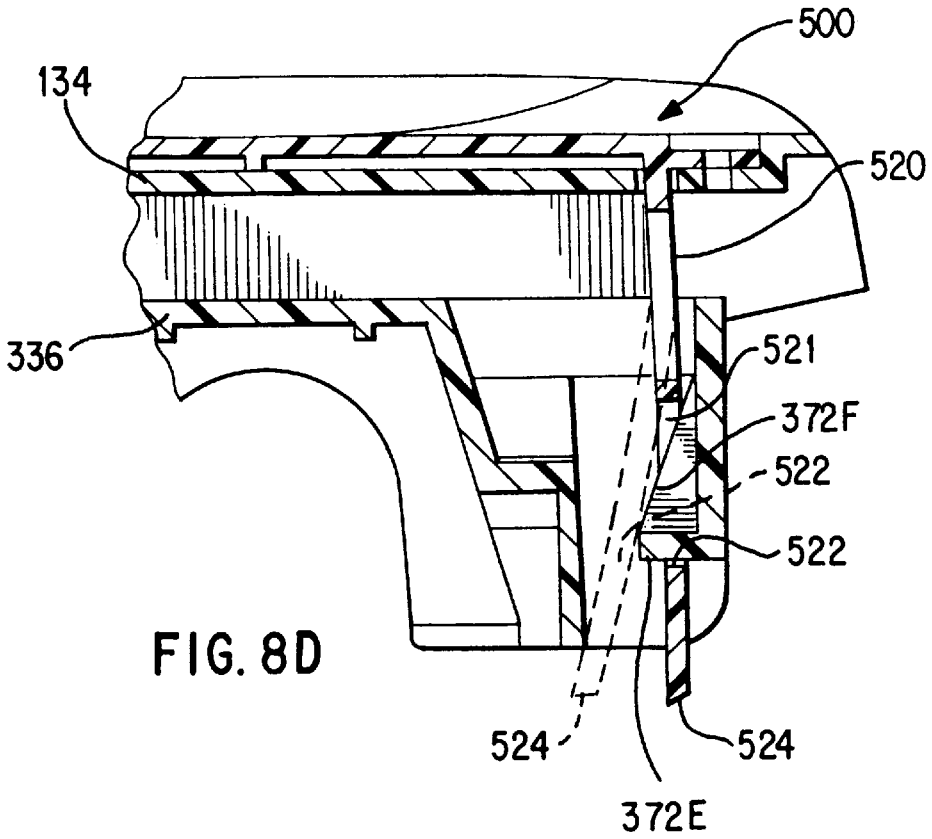
Figure 8E:
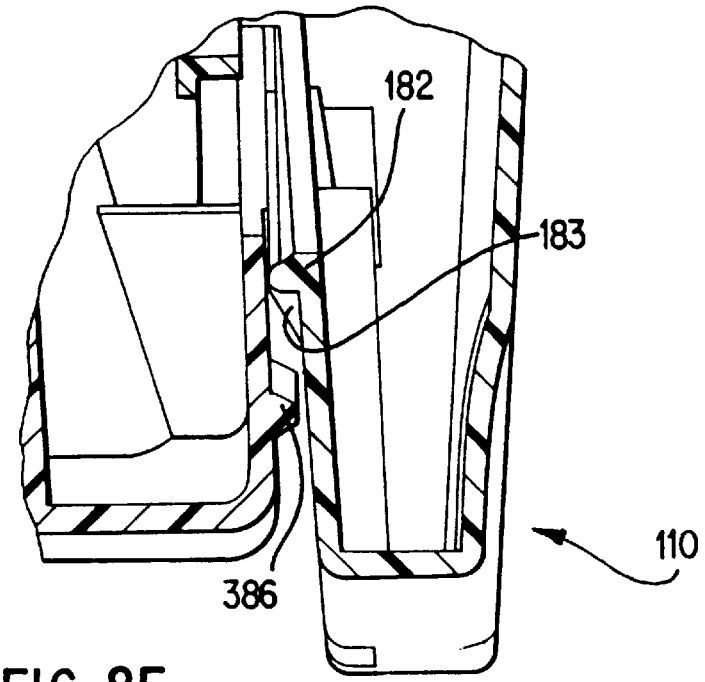
Figure 8F:
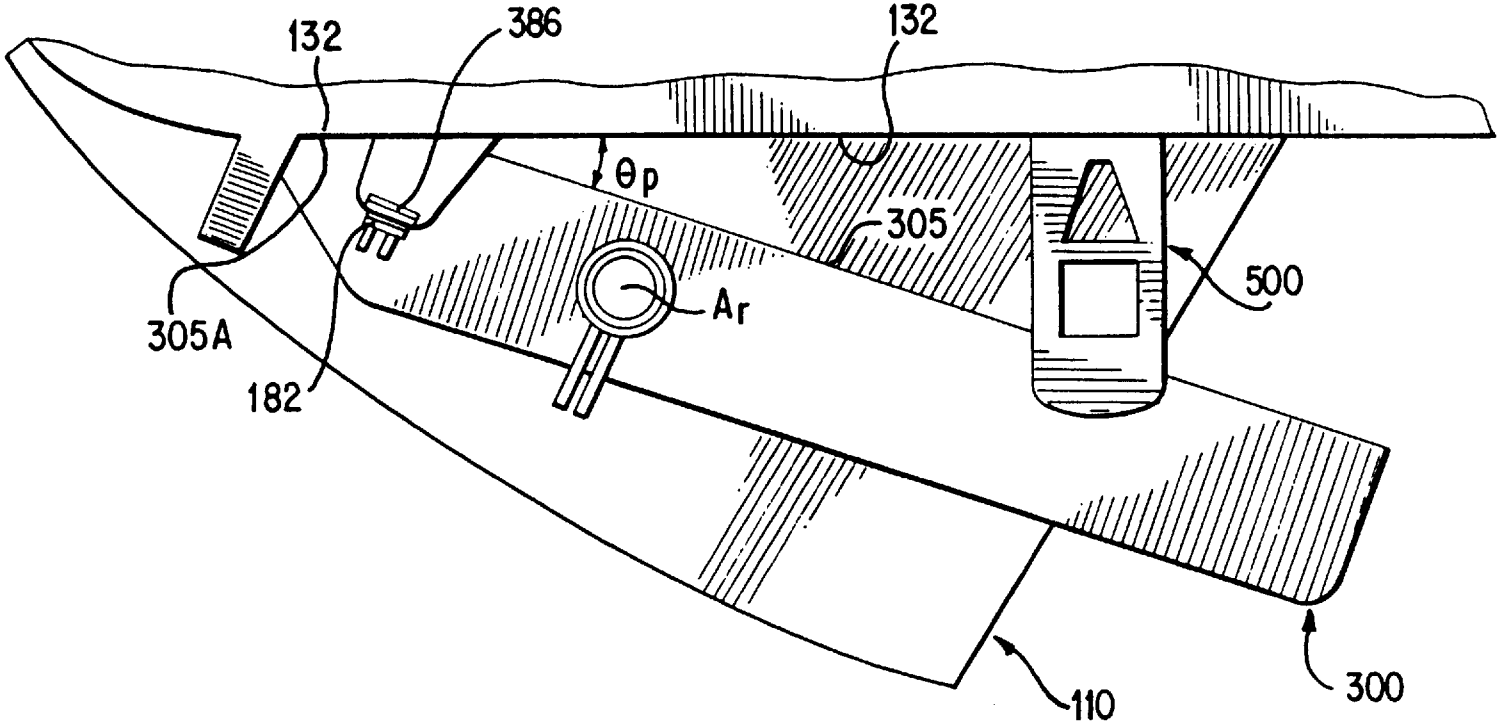
FIG. 8F is a schematic side view of the seat and pivot assembly of FIG. 3 in an upright orientation.

As shown in FIGS. 8B and 8E, when pivot plate 300 is in the recline position, left upright latch projection 386 is spaced rearwardly of left upright latch shoulder 182. However, if pivot plate 300 is rotated toward the upright position, the forward edge of projection 386 will engage latch ramp 182, and continued application of an external rotation force (such as by a user) will flex sidewall 112 in the region of left upright latch 180 outwardly until projection 386 clears shoulder 182 and pivot plate 300 reaches the upright position (FIG. 8F). Shoulder 182 will then be disposed rearward of projection 386, inhibiting rotation away from the upright position. However, application of a rotation force away from the upright position will bring the opposed, beveled rear surface of projection 386 and front surface of shoulder 182 into engagement and again flex sidewall 112 outwardly until projection 386 clears shoulder 182.

Seat and back portions 103 and 104 of seat 100 are arranged so that the center of gravity of the combination of the seat and an occupant child is positioned forward of recline pivot axis $A_r$ when the seat is in the upright position and, preferably, when the seat is in the recline position. The weight of the child and seat therefore urge the seat rotationally about axis $A_r$ toward the upright position. Thus, when the seat is in the upright position, the weight urges stop portion 305A against mounting wall 132, rather than urging the upright latch projections against the upright latches in a direction that would disengage the upright latch. Similarly, but less importantly, when the seat is in the recline position, the weight tends to urge recline latch shoulder 372E against the latch edges, placing the latch arms in tension.

The operation of seat-to-frame coupler assembly 20 is described with reference to FIG. 3. Seat 100 is attached to swing arm 260 by engaging pivot plate 300 with swing arm connector 400. To do so, pivot plate 300 is moved rearwardly toward front surface 414 of connector 400, with pivot plate rear wall 302 generally parallel to front surface 414 and receiving cavity 306 aligned with the connector. As connector 400 enters cavity 306, mounting posts 420, 422, 424, and 426 enter the entry portions of the respective slots 362, 364, 366, and 368 until the posts' front surfaces engage the slots' entry portion guide walls. The guide walls guide the posts to enter the lower ends of the slots' seating portions. Connector 400 is thus fully received in receiving cavity 306, with post portion 408 and transverse portion 410 of connector 400 received in post portion 308 and transverse portion 310, respectively, of cavity 306, and with lower segment 264 of swing arm 260 received in swing arm receiving portion 302B. Connector front surface 414 is engaged with pivot plate slide ribs 338A, 338B.

Seat 100 can then be translated forwardly and downwardly, parallel to swing arm 260's slide axis $A_x$, sliding the posts into the slots' seating portions until the posts' top surfaces engage the seating portions' stop walls. Seat 100 will then be suspended by pivot plate 300 from connector 400 and thus from swing arm 260. To remove the seat, the user simply applies an upwardly and rearwardly directed force, parallel to slide axis $A_x$, to the seat to lift the pivot plate's slots off the connector's posts until the posts enter the forward ends of the slots' entry portions and the seat can be pulled forwardly and upwardly off the connector.

In the illustrated embodiment, the swing frame tubes are formed of steel, seat 100 is injection molded of polypropylene for low cost, pivot plate 300 and connector 400 are injection molded of ABS for strength, and recline latch 500 is injection molded of acetal for springiness and low friction. Of course, other suitable materials may be selected by the artisan.

Although in the illustrated embodiment, pivot plate 300 has a cavity (female portion of seat-to-frame coupler assembly) and connector 400 is received in the cavity (male portion), and the pivot plate has slots formed in the sidewalls of the cavity while the connector has posts extending laterally from its peripheral sidewall, the artisan will appreciate that these relationships can be varied. Thus, the connector can have a cavity and receive the pivot plate, and posts can be formed in cavity sidewalls while slots are formed in a peripheral sidewall of a male member received in the cavity. Similarly, a combination of posts and slots can be put on each of the male and female members. Thus, although the particular connector/cavity and post/slot interaction arrangement described above is presently preferred, it is intended to be illustrative of the several combinations possible.

What is claimed is:

1. An infant swing comprising:

a swing arm having a lower portion with a longitudinal axis and first and second posts extending laterally away from said longitudinal axis;

a seat having a front, child-receiving surface and a rear mounting surface;

a connector coupled to said rear mounting surface and having first and second slots sized to slidably receive said first and second posts, respectively.

2. The swing of claim 1 where said connector is pivotally coupled to said rear mounting surface for pivotal movement relative to said seat through a range of angular motion bounded by an upright seat orientation and a reclined seat orientation and further comprising means for releasably securing said seat in said reclined seat orientation.

3. The swing of claim 2 further comprising means for releasably securing said seat in said upright seat orientation.

4. The infant swing of claim 1 wherein:

said lower portion has a projecting portion, said first and second posts being disposed on said projecting portion; and said connector includes a connector cavity defined by a peripheral sidewall and a backwall bounded by said peripheral sidewall and sized to receive said projection portion of said lower portion, said first and second slots being disposed in said peripheral sidewall.

5. The infant swing of claim 4 wherein said first and second slots are generally L-shaped, having a first, entry portion extending from an outer edge of said sidewall toward said backwall and a second, sliding portion extending generally parallel to said backwall.

6. An apparatus comprising:

a support having a first connector member a infant seat having a front, infant-supporting surface, an opposed rear, mounting surface, and first and second rails depending rearwardly from said mounting surface, said rails having laterally-opposed inner walls, each of said inner walls having a pivot mount;

a second connector member having a body portion, a forward surface disposed toward said seat mounting surface, an opposed rear surface, a peripheral sidewall intermediate to said forward and rear surfaces, first and second pivot posts extending outwardly from said sidewalls and pivotally engaged with said pivot mounts, said second connector member thereby being mounted for pivotable movement with respect to said seat, and a receiving cavity extending forwardly from said rear surface, said cavity releasably receiving and engaging said first connector member.

7. The apparatus of claim 6 wherein said seat is pivotable with respect to said second connector member between a first, recline position and a second, upright position, and further includes means for releasably retaining said seat in said recline position.

8. The apparatus of claim 7 further comprising means for releasably retaining said seat in said upright position.

9. The apparatus of claim 6 wherein:

said second connector member includes first and second slots formed in a peripheral sidewall of said cavity; and said first connector member includes first and second laterally extending posts sized to be slidably received in said first and second slots, respectively, when said first connector member is received in and engaged by said cavity.

10. A method for attaching an infant seat to a support, the method comprising the steps of:

disposing a first connector member on the seat, said connector member having a plurality of slots;

disposing a plurality of posts on, and laterally extending from, the support, said posts being sized and positioned on the said support to align, and slidably engage, with said slots;

aligning and slidably engaging said posts with said slots to attach the seat to the support.

11. The method of claim 10 further comprising the step of pivotally coupling said first connector member to said seat for pivotal movement relative to said seat through a range of angular motion bounded by an upright seat orientation and a reclined seat orientation.

12. The method of claim 11 further comprising the step of releasably securing said seat in said reclined seat orientation.

13. The method of claim 11 further comprising the step of releasably securing sid seat in said upright seat orientation.

* * * * *